US010545420B2

(12) United States Patent
Kinumatsu et al.

(10) Patent No.: US 10,545,420 B2
(45) Date of Patent: Jan. 28, 2020

(54) MAGNETIC TONER AND IMAGE-FORMING METHOD

(71) Applicant: CANON KABUSHIKI KAISHA, Tokyo (JP)

(72) Inventors: Tetsuya Kinumatsu, Mishima (JP); Yusuke Hasegawa, Suntou-gun (JP); Kosuke Fukudome, Tokyo (JP); Tomohisa Sano, Mishima (JP); Kenji Ookubo, Numazu (JP); Yoshitaka Suzumura, Mishima (JP); Takuma Ikejiri, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/018,420

(22) Filed: Jun. 26, 2018

(65) Prior Publication Data

US 2019/0011846 A1 Jan. 10, 2019

(30) Foreign Application Priority Data

Jul. 4, 2017 (JP) ..... 2017-131082
Jun. 7, 2018 (JP) ..... 2018-109318

(51) Int. Cl.

*G03G 9/083* (2006.01)
*G03G 9/087* (2006.01)
*G03G 15/08* (2006.01)
*G03G 9/08* (2006.01)

(52) U.S. Cl.

CPC ..... *G03G 9/0832* (2013.01); *G03G 9/0821* (2013.01); *G03G 9/0825* (2013.01); *G03G 9/0833* (2013.01); *G03G 9/08755* (2013.01); *G03G 9/08764* (2013.01); *G03G 9/08782* (2013.01); *G03G 15/0865* (2013.01)

(58) Field of Classification Search

CPC .... G03G 9/083; G03G 9/0838; G03G 9/0832; G03G 9/0825; G03G 9/0821; G03G 9/0833; G03G 13/08
USPC ..... 430/106.1, 106.2
See application file for complete search history.

(56) References Cited

U.S. PATENT DOCUMENTS 6,596,452 B2 * 7/2003 Magome ..... G03G 9/0827 430/106.2
6,703,176 B2 3/2004 Naka et al.
6,803,164 B2 10/2004 Mizoo et al.
6,953,646 B2 10/2005 Doujo et al.
7,123,862 B2 10/2006 Hasegawa et al.
7,160,660 B2 1/2007 Dojo et al.
7,368,211 B2 5/2008 Hasegawa et al.
7,470,494 B2 12/2008 Nishiyama et al.
7,582,401 B2 9/2009 Ogawa et al.
7,678,523 B2 3/2010 Hiroko et al.
7,678,524 B2 3/2010 Hasegawa et al.
7,704,659 B2 4/2010 Ogawa et al.
7,811,734 B2 10/2010 Ogawa et al.
7,923,190 B2 4/2011 Magome et al.
7,935,467 B2 5/2011 Dojo et al.
7,939,231 B2 5/2011 Ogawa et al.
8,084,174 B2 12/2011 Hasegawa et al.
8,124,306 B2 2/2012 Hitata et al.
8,227,162 B2 7/2012 Sano et al.
8,426,091 B2 4/2013 Magome et al.
8,426,094 B2 4/2013 Magome et al.
8,518,620 B2 8/2013 Dojo et al.
8,603,712 B2 12/2013 Aoki et al.
8,614,044 B2 12/2013 Matsui et al.
8,741,519 B2 6/2014 Watanabe et al.
8,778,585 B2 7/2014 Matsui et al.
8,841,054 B2 9/2014 Dojo et al.
8,846,284 B2 9/2014 Kinumatsu et al.
8,918,035 B2 12/2014 Hasegawa et al.
8,942,064 B2 1/2015 Coman et al.
9,029,055 B2 5/2015 Aoki et al.
9,034,549 B2 5/2015 Shiotari et al.
9,040,216 B2 5/2015 Fukudome et al.
9,097,997 B2 8/2015 Nomura et al.
9,116,448 B2 8/2015 Terauchi et al.
9,134,637 B2 9/2015 Hotta et al.
9,141,012 B2 9/2015 Moribe et al.
9,152,065 B2 10/2015 Sano et al.
9,213,250 B2 12/2015 Nomura et al.
9,213,251 B2 12/2015 Ohmori et al.
9,217,943 B2 12/2015 Matsui et al.
9,235,151 B2 1/2016 Tanaka et al.
9,239,528 B2 1/2016 Hasegawa et al.
9,244,371 B2 1/2016 Suzumura et al.
9,261,806 B2 2/2016 Moribe et al.
9,285,697 B2 3/2016 Fukudome et al.
9,309,349 B2 4/2016 Watanabe et al.
(Continued)

FOREIGN PATENT DOCUMENTS

JP 2006-243593 A 9/2006
JP 2012-093752 A 5/2012

OTHER PUBLICATIONS

U.S. Appl. No. 15/889,585, Shinnosuke Koji, filed Feb. 6, 2018.

*Primary Examiner* — Janis L Dote
(74) *Attorney, Agent, or Firm* — Venable LLP

(57) ABSTRACT

A magnetic toner is provided, which has a magnetic toner particle containing a binder resin, a wax, and a magnetic body, wherein, when Dn is a number-average particle diameter of the toner, CV1 is coefficient of variation of a brightness variance value of the toner in a particle diameter range of Dn −0.500 to +0.500, and CV2 is coefficient of variation of a brightness variance value of the toner in a particle diameter range of Dn −1.500 to −0.500, a relationship CV2/CV1≤1.00 is satisfied; an average brightness of the toner in the range of Dn −0.500 to +0.500 is 30.0 to 60.0; and when, in a cross section of the toner observed using a transmission electron microscope, which is divided with a square grid having a side of 0.8 μm, coefficient of variation CV3 of an occupied area percentage for the magnetic body is 40.0 to 80.0%.

8 Claims, 3 Drawing Sheets

(56) References Cited

U.S. PATENT DOCUMENTS

| | | | |
|---|---|---|---|
| 9,377,708 | B2 | 6/2016 | Magome et al. |
| 9,429,860 | B2 | 8/2016 | Kinumatsu et al. |
| 9,454,096 | B2 | 9/2016 | Hasegawa et al. |
| 9,470,993 | B2 | 10/2016 | Nishikawa et al. |
| 9,551,947 | B2 | 1/2017 | Hiroko et al. |
| 9,594,323 | B2 | 3/2017 | Fujikawa et al. |
| 9,606,462 | B2 | 3/2017 | Nomura et al. |
| 9,625,841 | B2 | 4/2017 | Hiroko et al. |
| 9,625,842 | B2 | 4/2017 | Uratani et al. |
| 9,625,844 | B2 | 4/2017 | Kaya et al. |
| 9,658,548 | B2 | 5/2017 | Magome et al. |
| 9,658,554 | B2 | 5/2017 | Kinumatsu et al. |
| 9,798,256 | B2 | 10/2017 | Kosaki et al. |
| 9,798,262 | B2 | 10/2017 | Toyoizumi et al. |
| 9,804,514 | B2 | 10/2017 | Suzumura et al. |
| 9,804,519 | B2 | 10/2017 | Suzumura et al. |
| 9,811,016 | B2 | 11/2017 | Aoki et al. |
| 9,823,595 | B2 | 11/2017 | Toyoizumi et al. |
| 9,841,692 | B2 | 12/2017 | Hasegawa et al. |
| 9,857,713 | B2 | 1/2018 | Kosaki et al. |
| 9,869,943 | B2 | 1/2018 | Aoki et al. |
| 9,880,478 | B2 | 1/2018 | Shimano et al. |
| 9,927,728 | B2 | 3/2018 | Arimura et al. |
| 9,946,179 | B2 | 4/2018 | Arimura et al. |
| 9,946,181 | B2 | 4/2018 | Hasegawa et al. |
| 9,964,874 | B2 | 5/2018 | Suzumura et al. |
| 9,964,881 | B2 | 5/2018 | Ikejiri et al. |
| 9,971,262 | B2 | 5/2018 | Hasegawa et al. |
| 9,971,263 | B2 | 5/2018 | Fukudome et al. |
| 9,971,264 | B2 | 5/2018 | Sano et al. |
| 10,012,923 | B2 | 7/2018 | Sano et al. |
| 2009/0197192 | A1 | 8/2009 | Hiroko et al. |
| 2016/0202624 | A1 | 7/2016 | Nishikawa et al. |
| 2016/0266509 | A1 | 9/2016 | Sano et al. |
| 2016/0378003 | A1 | 12/2016 | Arimura et al. |
| 2017/0160662 | A1 | 6/2017 | Nagashima et al. |
| 2017/0299972 | A1 | 10/2017 | Tanaka et al. |
| 2018/0004109 | A1 | 1/2018 | Matsui et al. |
| 2018/0173125 | A1 | 6/2018 | Fukudome et al. |
| 2018/0173126 | A1 | 6/2018 | Ohmori et al. |

* cited by examiner

MAGNETIC TONER AND IMAGE-FORMING METHOD

BACKGROUND OF THE INVENTION

Field of the Invention

The present invention relates to a magnetic toner used in recording methods that employ an electrophotographic system, an electrostatic recording system, or a toner jet recording system. The present invention further relates to an image-forming method that uses this magnetic toner.

Description of the Related Art

Image-output means have, in recent years, been in demand broadly in many sectors for use in, e.g., offices and homes, and an example is demand for high durability whereby, in various use environments, the image quality does not decline even when a large number of images are printed out. In addition to image quality, on the other hand, smaller sizes and lower energy consumption are being required of the image-output apparatus itself.

Downsizing the cartridge where the developer is held has been an effective means for achieving smaller size, and mono-component developing systems are thus preferred over two-component developing systems, which use a carrier. Contact developing systems are preferred in order at the same time to obtain high-quality images. Mono-component contact developing systems have as a result become an effective means for achieving the aforementioned features.

However, mono-component contact developing systems are developing systems in which the toner bearing member and electrostatic latent image bearing member are disposed in contact with each other (abutting disposition). That is, these bearing members transport the toner through rotation thereof, and a large shear is applied in the contact zone. Thus, in order to obtain a high-quality image, the toner must have a high durability and a high flowability.

A low-flowability toner ends up remaining at the bearing members during development, and melt adhesion is then facilitated due to the heat generated by rubbing. In particular, "streaks" end up being produced on the image when melt adhesion occurs at the toner bearing member.

On the other hand, with a low-durability toner, cracking and chipping occur, which causes a reduction in the image quality through, e.g., contamination of the toner bearing member and electrostatic latent image bearing member. In addition, toner that has been cracked and/or chipped is resistant to taking on charge and also functions as a "fogging" component that is eventually developed into the non-image areas on the electrostatic latent image bearing member.

In the case of magnetic body-containing magnetic toner (also referred to herebelow simply as toner), there is a large density difference between the resin and magnetic body. When an external force is applied, the resin undergoes fracture due to displacement due to the concentration of the force in the resin, and cracking and chipping of the toner in particular are facilitated.

When the output of a large number of prints is sought in a variety of use environments, additional load is applied to the toner and an even higher durability and an even higher flowability are then necessary.

A magnetic body-containing toner is proposed in Japanese Patent Application Laid-open No. 2006-243593.

Japanese Patent Application Laid-open No. 2012-93752 proposes a magnetic toner in which the magnetic body has been dispersed using an aggregation method. A production method like this has an aggregation step, in which fine particles are aggregated until the toner particle diameter is reached, and a coalescence step, in which coalescence and conversion to toner are carried out by melting the aggregate. With this method, changes in toner shape are readily brought about and the flowability can be increased.

SUMMARY OF THE INVENTION

Toner that uses the production method disclosed in Japanese Patent Application Laid-open No. 2006-243593 has the following problems: increasing circularity thereof is difficult, and melt adhesion by the toner readily occurs in systems where shear is applied, such as mono-component contact developing systems. Moreover, locations in the toner where the binder resin is segregated, such as domains (these locations are also referred to as binder resin domains hereafter), are scarce and the binder resin forms a fine network structure and the binder resin-to-binder resin connections end up being fine. The following problem occurs as a result: the binding strength acting within the resin is reduced and, in systems where shear is applied, the force cannot be absorbed and toner deterioration is then facilitated.

Like the toner disclosed in Japanese Patent Application Laid-open No. 2006-243593, the toner disclosed in Japanese Patent Application Laid-open No. 2012-93752 has a structure in which the binder resin domains in the toner are scarce and improving the binding strength within the resin is then impeded. As a result, in systems where shear is applied, the force cannot be absorbed and the problem arises that toner deterioration is facilitated.

Conversely, in toner in which the magnetic bodies are aggregated, the occurrence of fracture of the binder resin is impeded, but, due to a decline in the magnetic body surface area, the problem arises of a reduction in the tinting strength and a reduction in the density of the printed image.

Moreover, in the case of toner in which the magnetic bodies are aggregated, differences in the magnetic body content from toner particle to toner particle are prone to occur, and in particular the introduction of magnetic bodies into small-diameter toner particles is problematic. As a result, when a large number of prints are output, the problem arises of a gradual decline in the image density.

The present invention provides a magnetic toner that—in systems where strong shear is applied to the toner, as in a mono-component contact developing system—exhibits an excellent image quality, is resistant to environment variations, and exhibits an excellent stability.

The present inventors discovered that the aforementioned problems are solved by controlling the state of dispersion of the magnetic body in the magnetic toner. The present invention was achieved based on this discovery.

That is, the present invention is a magnetic toner having a magnetic toner particle containing a binder resin, a wax, and a magnetic body, wherein, when Dn (μm) is a number-average particle diameter of the magnetic toner, CV1 (%) is coefficient of variation of a brightness variance value of the magnetic toner in a particle diameter range from at least Dn −0.500 to not more than Dn +0.500, and CV2 (%) is coefficient of variation of the brightness variance value of the magnetic toner in a particle diameter range from at least Dn −1.500 to not more than Dn −0.500, the CV1 and the CV2 satisfy a relationship in formula (1) below;

average brightness of the magnetic toner in the particle diameter range from at least Dn −0.500 to not more than Dn +0.500 is at least 30.0 and not more than 60.0; and when, in a cross section of a magnetic toner observed using a transmission electron microscope, the cross section of the magnetic toner is divided with a square grid having a side of 0.8 μm, coefficient of variation CV3 of an occupied area percentage for the magnetic body is at least 40.0% and not more than 80.0%:

$$CV2/CV1 \leq 1.00 \quad (1).$$

The present invention is also an image-forming method including:

a charging step of charging an electrostatic latent image bearing member by applying voltage from the exterior to a charging member;

a latent image-forming step of forming an electrostatic latent image on the charged electrostatic latent image bearing member;

a developing step of developing the electrostatic latent image with a toner carried on a toner bearing member to form a toner image on the electrostatic latent image bearing member;

a transfer step of transferring, by using an intermediate transfer member or without using an intermediate transfer member, the toner image on the electrostatic latent image bearing member to a transfer material; and a fixing step of fixing, by using a means for applying heat and pressure, the toner image that has been transferred to the transfer material, wherein the developing step is based on a mono-component contact developing system in which development is carried out by direct contact of the electrostatic latent image bearing member with the toner carried on the toner bearing member; and the toner is a magnetic toner having a magnetic toner particle that contains a binder resin, a wax, and a magnetic body, and wherein, when Dn (μm) is a number-average particle diameter of the magnetic toner, CV1 (%) is coefficient of variation of a brightness variance value of the magnetic toner in a particle diameter range from at least Dn −0.500 to not more than Dn +0.500, and CV2 (%) is coefficient of variation of a brightness variance value of the magnetic toner in a particle diameter range from at least Dn −1.500 to not more than Dn −0.500, the CV1 and the CV2 satisfy a relationship in formula (1) below, an average brightness of the magnetic toner in the particle diameter range from at least Dn −0.500 to not more than Dn +0.500 is at least 30.0 and not more than 60.0, and when, in a cross section of a magnetic toner observed using a transmission electron microscope, the cross section of the magnetic toner is divided with a square grid having a side of 0.8 μm, coefficient of variation CV3 of an occupied area percentage for the magnetic body is at least 40.0% and not more than 80.0%:

$$CV2/CV1 \leq 1.00 \quad (1).$$

Further features of the present invention will become apparent from the following description of exemplary embodiments with reference to the attached drawings.

DESCRIPTION OF THE EMBODIMENTS

Figure 1:
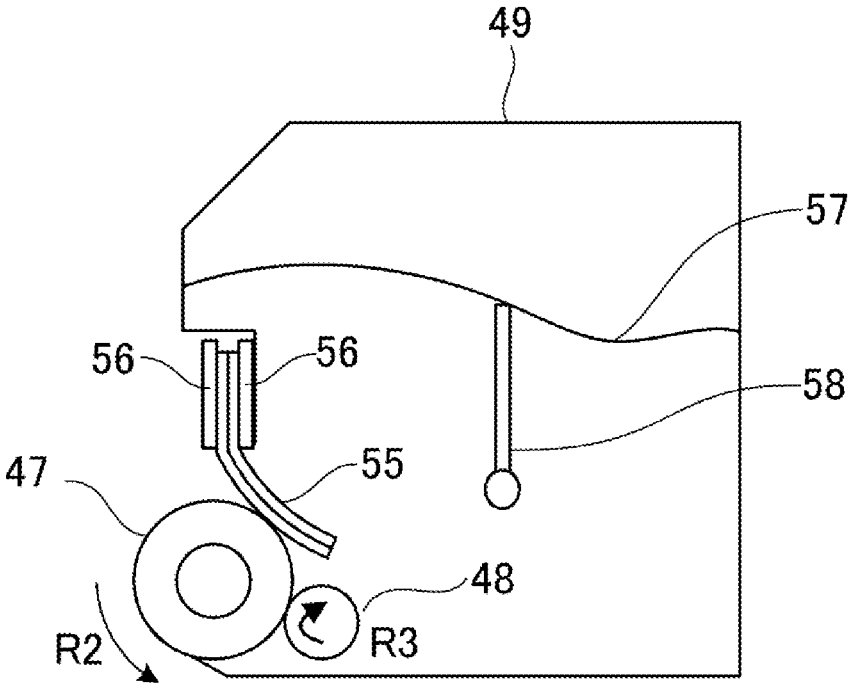
FIG. 1 is a schematic cross-sectional diagram of a developing apparatus.

Unless specifically indicated otherwise, the expressions "at least XX and not more than YY" and "XX to YY" that show numerical value ranges refer in the present invention to numerical value ranges that include the lower limit and upper limit that are the end points.

In addition, monomer unit refers to the reacted state of the monomer substance in a polymer.

The present invention is more particularly described in the embodiments thereof provided below, but these embodiments are not limiting.

The magnetic toner of the present invention (also referred to simply as toner in the following) is a magnetic toner having a magnetic toner particle containing a binder resin, a wax, and a magnetic body, wherein, when Dn (μm) is a number-average particle diameter of the magnetic toner, CV1 (%) is coefficient of variation of a brightness variance value of the magnetic toner in a particle diameter range from at least Dn −0.500 to not more than Dn +0.500, and CV2 (%) is coefficient of variation of the brightness variance value of the magnetic toner in a particle diameter range from at least Dn −1.500 to not more than Dn −0.500, the CV1 and the CV2 satisfy a relationship in formula (1) below;

an average brightness of the magnetic toner in the particle diameter range from at least Dn −0.500 to not more than Dn +0.500 is at least 30.0 and not more than 60.0; and when, in a cross section of a magnetic toner observed using a transmission electron microscope, the cross section of the magnetic toner is divided with a square grid having a side of 0.8 μm, coefficient of variation CV3 of an occupied area percentage for the magnetic body is at least 40.0% and not more than 80.0%:

$$CV2/CV1 \leq 1.00 \quad (1).$$

This magnetic toner is a magnetic toner for which the following are controlled: the average brightness and coefficient of variation of the brightness variance value of the magnetic toner at prescribed particle diameters, and the state of dispersion of the magnetic body in the magnetic toner particle (also referred to in the following simply as a toner particle).

In the case of systems that engage in magnetic transport as well as systems that carry out development through control of the charging performance and magnetic property of the toner, differences in the charging performance and magnetic property can occur due to differences in the content of the magnetic body in the toner, and this can cause the appearance of differences in behavior during development due to toner variation. This results in the potential for the appearance of image defects, e.g., a decline in image density. It is thus generally critical for magnetic body-containing toner that the magnetic body be incorporated uniformly from toner particle to toner particle.

In addition, the brightness of a toner is an index that represents the degree of light scattering by a toner, and the brightness of a toner is lowered by the incorporation of substances such as colorant and light-absorbing magnetic bodies.

The brightness variance value of a toner, on the other hand, is an index that shows the extent, in measurement of the brightness, of the variation in brightness in one particle of the toner particles. As a consequence, the coefficient of variation of the brightness variance value is an index that shows the extent of the interparticle variation in the brightness in toner particles.

The present inventors investigated control of the interparticle magnetic body content of magnetic toner particles and found that the dispersion of the magnetic body among toner particles could be made uniform by bringing the brightness and the coefficient of variation of the brightness variance value to favorable values, and discovered that an excellent image free of reductions in the density could then be obtained.

With regard to systems in which high shear is applied, such as mono-component contact developing systems, it was thought that, by forming the binder resin into domains and having sites that do not contain material other than the resin, the domains would absorb the force applied to the toner and cracking would be stopped.

That is, it was thought that having locations in the toner particle where the binder resin is segregated, i.e., having domains of the binder resin, would be an effective solution with regard to toner cracking and chipping.

However, it was quite difficult with regard to magnetic body-containing toner to bring about the presence of binder resin domains in each individual particle of the toner particles while having a uniform dispersion of the magnetic bodies among toner particles. A means for having these co-exist in good balance was nevertheless discovered. As a result, a toner could be produced in which the presence of binder resin domains could be brought about in each individual particle of the toner particles while obtaining a uniform dispersion of the magnetic bodies among toner particles. This toner is resistant to cracking and chipping and provides an excellent image.

When Dn (μm) is a number-average particle diameter of the magnetic toner, the average brightness of the magnetic toner in the particle diameter range from at least Dn −0.500 to not more than Dn +0.500 is at least 30.0 and not more than 60.0. This average brightness is preferably at least 35.0 and not more than 50.0.

By controlling the average brightness into the indicated range, an excellent tinting strength is exhibited and, even in the case of continuous image output, reductions in the image density are suppressed.

When this average brightness is less than 30.0, the magnetic body content is then large, toner cracking is facilitated, and fogging is produced.

When this average brightness exceeds 60.0, the magnetic body content is then low, the tinting strength is reduced, and a decline in the image density is caused at the beginning of the output of a large number of prints.

Adjustment of the magnetic body content may be carried out in order to control the average brightness into the indicated range.

The method for measuring the average brightness is described below.

Using CV1 (%) for the coefficient of variation of the brightness variance value of the magnetic toner in the particle diameter range from at least Dn −0.500 to not more than Dn +0.500 and CV2 (%) for the coefficient of variation of the brightness variance value of the magnetic toner in the particle diameter range from at least Dn −1.500 to not more than Dn −0.500, the CV1 and the CV2 satisfy the relationship in formula (1).

$$CV2/CV1 \leq 1.00 \quad (1)$$

This CV2/CV1 is preferably at least 0.70 and not more than 0.95.

When CV2/CV1 is equal to or less than 1.00, the magnetic body content in the magnetic toner particles then exhibits little dependence on the particle diameter of the toner particle. As a result, nonuniformity in the charging of the toner particles and nonuniformity in the magnetic properties of the toner particles are suppressed and an excellent developing performance is provided even when a large number of prints are output.

When CV2/CV1 exceeds 1.00, the magnetic body content in the magnetic toner particles depends on the particle diameter of the toner particle and the incorporation of magnetic bodies in small-diameter toner particles is impeded. As a result, when a large number of prints are output, toner particles having a high magnetic body content are selectively output in the first half of the print run, and as a consequence toner particles having a low magnetic body content remain present in large amounts in the second half of the print run, causing a decline in the image density.

Adjusting the particle diameter of the magnetic body is an example of a means for controlling CV2/CV1 into the indicated range. In addition, toner particle production may be carried out using a pulverization method or emulsion aggregation method, which support and facilitate the incorporation of the magnetic body in small-diameter particles.

The methods for measuring the brightness variance value and its coefficient of variation are described below.

CV1 is preferably at least 1.00% and not more than 4.00% and is more preferably at least 1.00% and not more than 3.50%. 1.00% is the lower limit value for CV1.

When CV1 is in the indicated range, there is then little difference in the state of occurrence of the magnetic bodies from toner particle to toner particle and changes in the image density during continuous image output are suppressed and an excellent image is obtained.

The CV1 can be adjusted by controlling the state of dispersion of the magnetic bodies during toner particle production.

When, in the cross section of the magnetic toner observed using a transmission electron microscope (TEM), the cross section of the instant magnetic toner is divided with a square grid having a side of 0.8 μm, the coefficient of variation CV3 of the occupied area percentage for the magnetic body is at least 40.0% and not more than 80.0%. This CV3 is preferably at least 50.0% and not more than 70.0%.

The specification of this CV3 in the aforementioned range indicates that the magnetic bodies are locally segregated in the magnetic toner particle. That is, through the segregation of the magnetic bodies in the magnetic toner particle, regions where the magnetic bodies are not present (i.e., binder resin domain regions) can be established at an appropriate level and externally applied shear can then be absorbed by these regions. As a result, toner cracking is suppressed and, in systems where high shear is applied such as mono-component contact developing systems, an excellent image can be obtained during the output of a large number of prints, i.e., reductions in image density do not occur, the image defects referred to as development streaks do not occur, and fogging is not produced.

When CV3 is less than 40.0%, there is then little difference in the occupied area percentage for the magnetic body between the individual grids into which the cross section of the magnetic toner is divided, which means that binder resin domains are not present or that few binder resin domains are present.

In this case, the majority of the binder resin forms a fine network structure and the connections running through the binder resin with itself then end up being fine. As a result, in systems in which high shear is applied to the toner, as in a mono-component contact developing system, toner cracking is facilitated and fogging caused by poor charging is produced.

When, on the other hand, this CV3 exceeds 80.0%, the magnetic bodies assume a state of excessive localization within the toner. In this case, the magnetic bodies have undergone aggregation with each other and the tinting strength is reduced in conjunction with the decline in surface area and the image density at the beginning of image output is reduced.

The following methods can be used to adjust CV3 into the aforementioned range: control of the hydrophilicity/hydrophobicity of the surface of the magnetic body; control of the degree of aggregation of the magnetic bodies during toner particle production.

For example, the following procedures may be employed when an emulsion aggregation method is used: the magnetic bodies may be preliminarily aggregated followed by introduction into the toner particle; the degree of magnetic body aggregation may be adjusted by the addition of a chelating agent, and/or by adjusting the pH, in the coalescence step.

In the magnetic toner cross section observed using a transmission electron microscope (TEM), the average value of the occupied area percentage for the magnetic body, when the cross section of the magnetic toner is divided with a square grid having a side of 0.8 μm, is preferably at least 10.0% and not more than 40.0% and is more preferably at least 15.0% and not more than 30.0%.

When the average value of the occupied area percentage is in the indicated range, the state of dispersion of the magnetic bodies in the toner particle assumes an advantageous state and the reduction in tinting strength due to an excessive state of aggregation can then be suppressed.

In addition, the binder resin domains will also occur in appropriate amounts and the generation of toner cracking is then suppressed. As a result, the occurrence of fogging is suppressed and an excellent image is obtained.

The following are examples of methods for controlling the average value of the occupied area percentage for the magnetic bodies into the aforementioned range: controlling the hydrophilicity/hydrophobicity of the magnetic body surface; controlling the degree of aggregation of the magnetic bodies during toner particle production.

There are no particular limitations on the binder resin, and the resins known for use in toners may be used. The binder resin can be specifically exemplified by polyester resins, polyurethane resins, and vinyl resins.

The following monomers are examples of monomers that can be used to produce the vinyl resins.

Aliphatic vinyl hydrocarbons: alkenes, for example, ethylene, propylene, butene, isobutylene, pentene, heptene, diisobutylene, octene, dodecene, octadecene, and α-olefins other than the preceding; and alkadienes, for example, butadiene, isoprene, 1,4-pentadiene, 1,5-hexadiene, and 1,7-octadiene.

Alicyclic vinyl hydrocarbons: mono- and dicycloalkenes and alkadienes, for example, cyclohexene, cyclopentadiene, vinylcyclohexene, and ethylidenebicycloheptene; and terpenes, for example, pinene, limonene, and indene.

Aromatic vinyl hydrocarbons: styrene and hydrocarbyl (alkyl, cycloalkyl, aralkyl, and/or alkenyl)-substituted forms thereof, for example, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene; and vinylnaphthalene.

Carboxyl group-containing vinyl monomers and metal salts thereof: unsaturated monocarboxylic acids and unsaturated dicarboxylic acids having at least 3 and not more than 30 carbons and anhydrides thereof and monoalkyl (at least 1 and not more than 27 carbons) esters thereof, for example, acrylic acid, methacrylic acid, maleic acid, maleic anhydride, the monoalkyl esters of maleic acid, fumaric acid, the monoalkyl esters of fumaric acid, crotonic acid, itaconic acid, the monoalkyl esters of itaconic acid, the glycol monoester of itaconic acid, citraconic acid, the monoalkyl esters of citraconic acid, and the carboxyl group-bearing vinyl monomers of cinnamic acid.

Vinyl esters, for example, vinyl acetate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate, ethyl α-ethoxyacrylate, alkyl acrylates and alkyl methacrylates having an alkyl group (linear or branched) having at least 1 and not more than 22 carbons (for example, methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, and behenyl methacrylate), dialkyl fumarates (dialkyl esters of fumaric acid wherein the two alkyl groups are linear, branched, or alicyclic groups having at least 2 and not more than 8 carbons), dialkyl maleate (dialkyl esters of maleic acid wherein the two alkyl groups are linear, branched, or alicyclic groups having at least 2 and not more than 8 carbon atoms), vinyl monomers that have a polyalkylene glycol chain (polyethylene glycol (molecular weight=300) monoacrylate, polyethylene glycol (molecular weight=300) monomethacrylate, polypropylene glycol (molecular weight=500) monoacrylate, polypropylene glycol (molecular weight=500) monomethacrylate, the acrylate of the 10 mol adduct of ethylene oxide (ethylene oxide is also abbreviated below as EO) on methyl alcohol, the methacrylate of the 10 mol adduct of ethylene oxide on methyl alcohol, the acrylate of the 30 mol adduct of EO on lauryl alcohol, and the methacrylate of the 30 mol adduct of EO on lauryl alcohol), and polyacrylates and polymethacrylates (the polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

Carboxy group-bearing vinyl esters: for example, carboxyalkyl acrylates in which the alkyl chain has at least 3 and not more than 20 carbons, and carboxyalkyl methacrylates in which the alkyl chain has at least 3 and not more than 20 carbons.

Among the preceding, for example, styrene, butyl acrylate, and β-carboxyethyl acrylate are preferred.

Monomers that can be used to produce the polyester resins can be exemplified by heretofore known dibasic and tribasic and higher carboxylic acids and dihydric and trihydric and higher alcohols. Specific examples of these monomers are given in the following.

The dibasic carboxylic acids can be exemplified by dibasic acids such as oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, phthalic acid, isophthalic acid, terephthalic acid, and dodecenylsuccinic acid and anhydrides and lower alkyl esters thereof, and also by aliphatically unsaturated dicarboxylic acids such as maleic acid, fumaric acid, itaconic acid, and citraconic acid. The lower alkyl esters and anhydrides of these dicarboxylic acids may also be used.

The tribasic and higher carboxylic acids can be exemplified by 1,2,4-benzenetricarboxylic acid and 1,2,5-benzenetricarboxylic acid and anhydrides and lower alkyl esters thereof.

A single one of the preceding may be used by itself or two or more may be used in combination.

The dihydric alcohols can be exemplified by alkylene glycols (1,2-ethanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol); alkylene ether glycols (polyethylene glycol and polypropylene glycol); alicyclic diols (1,4-cyclohexanedimethanol); bisphenols (bisphenol A); the alkylene oxide (ethylene oxide and propylene oxide) adducts on alicyclic diols, and the alkylene oxide (ethylene oxide or propylene oxide) adducts on bisphenols (bisphenol A).

The alkyl moiety of the alkylene glycol or alkylene ether glycol may be linear or branched. Alkylene glycols having a branched structure are also preferably used in the present invention.

Aliphatic diols having a double bond may also be used. Aliphatic diols having a double bond can be exemplified by the following compounds:

2-butene-1,4-diol, 3-hexene-1,6-diol, and 4-octene-1,8-diol.

The trihydric and higher alcohols can be exemplified by glycerol, trimethylolethane, trimethylolpropane, and pentaerythritol.

A single one of the preceding may be used by itself or two or more may be used in combination.

With the goal of adjusting the acid value or hydroxyl value, a monobasic acid such as acetic acid or benzoic acid and/or a monohydric alcohol such as cyclohexanol or benzyl alcohol may also be used on an optional basis.

There are no particular limitations on the method for synthesizing the polyester resin, and, for example, a transesterification method or direct polycondensation method may be used by itself, or these may be used in combination.

The polyurethane resins are described as follows.

Polyurethane resins are the reaction product of a diol and a diisocyanate group-containing compound. Polyurethane resins having various functionalities can be obtained by combining various diols and diisocyanate group-containing compounds.

The diisocyanate group-containing compounds can be exemplified by the following: aromatic diisocyanates having at least 6 and not more than 20 carbons (excluding the carbon in the NCO group; this also applies in the following), aliphatic diisocyanates having at least 2 and not more than 18 carbons, alicyclic diisocyanates having at least 4 and not more than 15 carbons, and modifications of these diisocyanates (modifications that contain the urethane group, carbodiimide group, allophanate group, urea group, biuret group, uretdione group, uretimine group, isocyanurate group, or oxazolidone group; also referred to as "modified diisocyanates" in the following). A mixture of two or more of the preceding is another example.

The aromatic diisocyanates can be exemplified by m-and/or p-xylylene diisocyanate (XDI) and $\alpha,\alpha,\alpha',\alpha'$-tetramethylxylylene diisocyanate.

The aliphatic diisocyanates can be exemplified by ethylene diisocyanate, tetramethylene diisocyanate, hexamethylene diisocyanate (HDI), and dodecamethylene diisocyanate.

The alicyclic diisocyanates can be exemplified by isophorone diisocyanate (IPDI), dicyclohexylmethane-4,4'-diisocyanate, cyclohexylene diisocyanate, and methylcyclohexylene diisocyanate.

Among the preceding, aromatic diisocyanates having at least 6 and not more than 15 carbons, aliphatic diisocyanates having at least 4 and not more than 12 carbons, and alicyclic diisocyanates having at least 4 and not more than 15 carbons are preferred, while XDI, IPDI, and HDI are more preferred. A trifunctional or higher functional isocyanate compound may also be used in addition to the preceding.

The dihydric alcohols referenced above as useable for polyesters are examples of the diols that can be used for the polyurethane resin.

One resin selected from polyester resins, polyurethane resins, vinyl resins, and so forth may be used by itself for the binder resin, or two or more of these resins may be used in combination. When two or more are used in combination, this may take the form of a composite resin in which the resins are chemically bonded to each other.

Viewed from the standpoint of the low-temperature fixability, the glass transition temperature (Tg) of the binder resin is preferably at least 40.0° C. and not more than 120.0° C.

A known wax may be used as the wax here.

Specific examples are petroleum waxes such as paraffin wax, microcrystalline wax, and petrolatum, and derivatives thereof; montan wax and derivatives thereof; hydrocarbon waxes provided by the Fischer-Tropsch method, and derivatives thereof; polyolefin waxes as represented by polyethylene and polypropylene, and derivatives thereof; natural waxes such as carnauba wax and candelilla wax, and derivatives thereof; and ester waxes.

Here, the derivatives include oxides and the block copolymers and graft modifications with vinyl monomers. Monofunctional ester waxes having one ester bond in each molecule and difunctional ester waxes having two ester bonds in each molecule are most prominently used for the ester wax, but polyfunctional ester waxes, e.g., tetrafunctional and hexafunctional, can be used.

The wax content, per 100.0 mass parts of the binder resin, is preferably at least 1.0 mass parts and not more than 30.0 mass parts and is more preferably at least 3.0 mass parts and not more than 20.0 mass parts.

A further enhancement of the release performance of the toner particle can be brought about by adjusting the wax content into the indicated range, and the occurrence of wraparound by the transfer paper can be suppressed even when the fixing member resides at low temperature. In addition, because the exposure of the wax at the toner particle surface can be brought into a favorable state, outmigration by the wax to the toner particle surface can be impeded even in a high-temperature environment and the maintenance of a high toner flowability is facilitated. The result is that suppression of the occurrence of development streaks in high-temperature environments is facilitated.

The peak temperature of the maximum endothermic peak for the wax, as measured using a differential scanning calorimeter (DSC), is preferably at least 60° C. and not more than 140° C. and is more preferably at least 60° C. and not more than 90° C.

When this peak temperature of the maximum endothermic peak is in the indicated range, plasticization of the magnetic toner during fixing is then facilitated and the low-temperature fixability is further enhanced. In addition, the generation of, e.g., wax outmigration, is suppressed even during long-term storage.

Preferably the wax forms domains in the interior of the magnetic toner particle, and the number-average diameter of these domains is preferably at least 50 nm and not more than 500 nm and is more preferably at least 100 nm and not more than 400 nm.

With regard to this number-average diameter of the domains, 30 wax domains having a major axis of at least 20 nm are randomly selected in the magnetic toner particle cross section acquired using a transmission electron microscope (TEM); the average value of the major axis and minor axis is taken to be the domain diameter; and the average value of the 30 domains is taken to be the number-average diameter of the domains. The domains do not have to be selected from the same toner particle.

When the number-average diameter of the domains is in the indicated range, excessive aggregation of the magnetic bodies can be suppressed and the outmigration of the wax to the toner particle surface in a high-temperature environment can be reduced. As a result, maintenance of a high toner flowability in high-temperature environments is facilitated and the production of development streaks can be further suppressed. In addition, maintenance of the crystalline structure of the wax is also facilitated in systems where a high shear is applied, such as mono-component contact developing systems. As a result, outmigration of the wax to the toner particle surface is reduced and the production of development streaks can be suppressed still further.

The number-average diameter of the domains can be adjusted by using the amount of wax addition and, when the emulsion aggregation method is used for the toner production method, by utilizing, for example, the wax particle diameter in the wax dispersion and the holding time in the coalescence step.

In the cross section of the magnetic toner particle obtained using a transmission electron microscope, and using Ws for the occupied area percentage for the wax in the region within 1.0 μm from the contour of the cross section, this Ws preferably is at least 1.5% and not more than 18.0% and is more preferably at least 2.0% and not more than 15.0%.

When Ws is in the indicated range, an appropriate amount of wax is then present in the vicinity of the toner particle surface layer and segregation of the wax to the toner particle surface and localization of the magnetic bodies can be prevented.

As a result, in systems where a high shear is applied to the toner, such as mono-component contact developing systems, the fogging caused by toner cracking and the development streaks caused by wax outmigration can be suppressed still further.

When Ws is less than 1.5%, a structure is readily assumed in which the wax is segregated to the interior of the toner and the magnetic bodies are segregated to the surface. As a result, a trend is assumed in which the generation of toner cracking and the production of fogging are facilitated.

When, on the other hand, Ws exceeds 18.0%, a large amount of wax then resides in the neighborhood of the toner surface layer. In systems in which a high shear is applied, such as mono-component contact developing systems, the long-term shear applied to the toner facilitates the destruction of the crystalline structure in a portion of the wax and the wax then readily assumes a melted state. As a result, the potential for wax outmigration to the toner surface is increased and the occurrence of development streaks is facilitated.

This Ws can be adjusted through the amount of wax addition and the heat-treatment time and heat-treatment temperature during the toner production step. In addition, when an emulsion aggregation method is used for the toner production method, the wax aggregation rate may be controlled and/or the timing of mixing with the other materials may be controlled.

Using Wc for the occupied area percentage for the wax in the interior region positioned further toward inside than inside 1.0 μm away from the contour of the cross section in the magnetic toner particle cross section acquired using a transmission electron microscope, the ratio of Wc to Ws (Wc/Ws) is preferably at least 2.0 and not more than 10.0 and is more preferably at least 3.0 and not more than 8.0.

By having this Wc/Ws be in the indicated range, a state can be brought about in which the wax is not localized in the surface layer of the toner particle. As a result, a suitable amount of wax is present in the neighborhood of the surface layer of the toner particle and segregation of the wax to the toner particle surface and localization of the magnetic bodies can be prevented.

As a result, it becomes possible, in systems in which a high shear is applied to the toner, such as mono-component contact developing systems, to further suppress the fogging caused by toner cracking and the development streaks caused by wax outmigration, and an excellent image can be obtained on a long-term basis.

A large amount of wax resides in the neighborhood of the toner surface layer when Wc/Ws is less than 2.0. In systems in which a high shear is applied, such as mono-component contact developing systems, the long-term shear applied to the toner disrupts the crystalline structure in a portion of the wax and the wax then assumes a melted state. As a result, the potential for wax outmigration at the toner surface is increased and the occurrence of development streaks is facilitated.

When, on the other hand, Ws exceeds 10.0, a structure is readily assumed in which the magnetic bodies are segregated to the surface, and the occurrence of cracking of the magnetic toner is then facilitated and the occurrence of fogging is facilitated.

Wc/Ws can be adjusted through the amount of wax addition and the heat-treatment time and heat-treatment temperature during the toner production step. In addition, when an emulsion aggregation method is used for the toner production method, the wax aggregation rate may be controlled and/or the timing of mixing with other materials may be controlled.

The magnetic body can be exemplified by iron oxides such as magnetite, maghemite, and ferrite; metals such as iron, cobalt, and nickel; and the alloys and mixtures of these metals with metals such as aluminum, copper, magnesium, tin, zinc, beryllium, calcium, manganese, selenium, titanium, tungsten, and vanadium.

The number-average particle diameter of the primary particles of the magnetic body is preferably not more than 0.50 μm and is more preferably at least 0.05 μm and not more than 0.30 μm.

The number-average particle diameter of the primary particles of the magnetic body present in the toner particle can be measured using a transmission electron microscope.

Specifically, the toner particles to be observed are thoroughly dispersed in an epoxy resin followed by curing for 2 days in an atmosphere with a temperature of 40° C. to obtain a cured material. A thin-section sample is prepared from this cured material using a microtome; image acquisition is performed at a magnification of 10,000× to 40,000× using a transmission electron microscope (TEM); and the projected areas of 100 primary particles of the magnetic bodies in this image are measured. The equivalent diameter of the circle equal to the projected area is used as the particle diameter of the primary particles of the magnetic body, and the average relative to these 100 magnetic bodies is used as the particle diameter of the primary particles of the magnetic body.

With regard to the magnetic properties of the magnetic body under the application of 795.8 kA/m, the coercive force (Hc) is preferably 1.6 to 12.0 kA/m. The intensity of magnetization (σs) is preferably 50 to 200 $Am^2/kg$ and is more preferably 50 to 100 $Am^2/kg$. The residual magnetization (ar), on the other hand, is preferably 2 to 20 $Am^2/kg$.

The content of the magnetic body in the magnetic toner is preferably at least 35 mass % and not more than 50 mass % and is more preferably at least 40 mass % and not more than 50 mass %.

An appropriate magnetic attraction to the magnet roll within the developing sleeve is generated when the magnetic body content is in the indicated range.

The content of the magnetic body in the magnetic toner can be measured using a Q5000IR TGA thermal analysis instrument from PerkinElmer Inc. For the measurement method, the magnetic toner is heated from normal temperature to 900° C. at a ramp rate of 25° C./minute in a nitrogen atmosphere, and the mass loss at 100° C. to 750° C. is taken to be the mass of the component excluding the magnetic body from the magnetic toner, while the residual mass is taken to be the amount of the magnetic body.

The magnetic body can be produced, for example, by the following method.

An aqueous solution containing ferrous hydroxide is prepared by the addition, to an aqueous ferrous salt solution, of alkali, e.g., sodium hydroxide, at an equivalent or more relative to the iron component. Air is injected while maintaining the pH of the prepared aqueous solution at 7 or above and an oxidation reaction is performed on the ferrous hydroxide while heating the aqueous solution to at least 70° C. and seed crystals that are a core for the magnetic iron oxide are first produced.

Then, an aqueous solution containing approximately 1 equivalent of ferrous sulfate based on the amount of addition of the previously added alkali, is added to the seed crystal-containing slurry. While maintaining the pH of the mixture at 5 to 10 and injecting air, the reaction of the ferrous hydroxide is advanced and the magnetic iron oxide is grown using the seed crystals as a core. At this point, the shape and magnetic properties of the magnetic body can be controlled through judicious selection of the pH, reaction temperature, and stirring conditions. The pH of the mixture shifts to the acid side as the oxidation reaction progresses, and the pH of the solution should not fall below 5. The magnetic body obtained proceeding in this manner is then filtered, washed, and dried by conventional methods to yield the magnetic body.

A known surface treatment may as necessary be carried out on this magnetic body.

The magnetic toner particle may contain a charge control agent. The magnetic toner is preferably a negative-charging toner.

Organometal complex compounds and chelate compounds are effective as charge control agents for negative charging, and examples are monoazo metal complex compounds, acetylacetone metal complex compounds, and metal complex compounds of aromatic hydroxycarboxylic acids and aromatic dicarboxylic acids.

Specific examples of commercial products are SPILON BLACK TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single charge control agent may be used by itself or two or more may be used in combination.

Viewed from the standpoint of the amount of charge, the content of the charge control agent, per 100 mass parts of the binder resin, is preferably at least 0.1 mass parts and not more than 10.0 mass parts and is more preferably at least 0.1 mass parts and not more than 5.0 mass parts.

The method of producing the magnetic toner is not particularly limited, and either a dry production method (for example, a kneading and pulverization method) or a wet method (for example, an emulsion aggregation method, suspension polymerization method, or dissolution suspension method) may be used. The use of an emulsion aggregation method is preferred among the preceding.

The use of an emulsion aggregation method facilitates adjustment of the coefficient of variation of the brightness variance value of the magnetic toner, the coefficient of variation of the occupied area percentage for the magnetic body, the number-average diameter of the wax domains, Wc/Ws, and so forth, into the ranges given above.

A toner particle production method using the emulsion aggregation method is described in the following using a specific example.

The emulsion aggregation method broadly contains the following four steps:

(a) a step of preparing a fine particle dispersion; (b) an aggregation step in which aggregated particles are formed; (c) a coalescence step in which a toner particle is formed by melting and coalescence; and (d) a step of washing and drying.

(a) The Step of Preparing a Fine Particle Dispersion

The fine particle dispersion is a dispersion of fine particles in an aqueous medium.

The aqueous medium can be exemplified by alcohols and by water, e.g., distilled water, deionized water, and so forth. A single one of these may be used by itself or two or more may be used in combination.

An auxiliary agent may be used in order to bring about the dispersion of the fine particles in the aqueous medium, and surfactants are an example of this auxiliary agent.

The surfactants can be exemplified by anionic surfactants, cationic surfactants, amphoteric surfactants, and nonionic surfactants.

Specific examples are anionic surfactants such as alkylbenzenesulfonate salts, α-olefinsulfonate salts, and phosphate esters; cationic surfactants such as amine salts, e.g., alkylamine salts, aminoalcohol/fatty acid derivatives, polyamine/fatty acid derivatives, and imidazoline, and quaternary ammonium salts, e.g., alkyltrimethylammonium salts, dialkyldimethylammonium salts, alkyldimethylbenzylammonium salts, pyridinium salts, alkylisoquinolinium salts, and benzethonium chloride; nonionic surfactants such as fatty acid amide derivatives and polyhydric alcohol derivatives; and amphoteric surfactants such as alanine, dodecyldi(aminoethyl)glycine, di(octylaminoethyl)glycine, and N-alkyl-N,N-dimethylammonium betaine.

A single one of these surfactants may be used by itself or two or more may be used in combination.

The method of preparing the fine particle dispersion can be selected as appropriate depending on the type of dispersoid.

For example, the dispersoid may be dispersed using a common disperser, e.g., a rotational shear-type homogenizer or a media-based ball mill, sand mill, or DYNO-MILL. In the case of a dispersoid that dissolves in organic solvent, dispersion in the aqueous medium may be carried using a phase inversion emulsification method. Phase inversion emulsification is a method in which the substance to be dispersed is dissolved in an organic solvent capable of dissolving the substance; the organic continuous phase (O phase) is made neutral; and, by the introduction of an aqueous medium (W phase), conversion of the resin from W/O to O/W (i.e., phase inversion) is carried out, causing conversion to a discontinuous phase with dispersion in particulate form in the aqueous medium.

The solvent used in the phase inversion emulsification method should be a solvent that dissolves the resin, but is not otherwise particularly limited. However, given the goal of droplet formation, the use is preferred of a hydrophobic or amphiphilic organic solvent.

A dispersion of fine particles may also be prepared by carrying out polymerization after the formation of droplets in an aqueous medium, as in emulsion polymerization. Emulsion polymerization is a method in which a precursor to the substance to be dispersed is mixed with an aqueous medium and a polymerization initiator, followed by the generation, by stirring or the application of shear, of a fine particle dispersion in which the substance is dispersed in the aqueous medium. An organic solvent or surfactant may be used as an emulsification aid at this time. Conventional devices may be used for the apparatus for carrying out stirring or the application of shear, and examples are common devices such as rotational shear-type homogenizers.

The magnetic body dispersion may be a dispersion in an aqueous medium of magnetic bodies for which the primary particle diameter is the desired particle diameter. A common disperser, e.g., a rotational shear-type homogenizer or a media-based ball mill, sand mill, or DYNO-MILL, may be used to effect dispersion. Since the magnetic body has a higher specific gravity than water and thus has a fast sedimentation rate, the aggregation step is preferably carried out immediately after dispersion.

Viewed from the standpoints of the ease of coalescence and controlling the aggregation rate, the number-average particle diameter of the dispersoid in the fine particle dispersion is preferably at least 0.01 μm and not more than 1 μm, more preferably at least 0.08 μm and not more than 0.8 μm, and still more preferably at least 0.1 μm and not more than 0.6 μm.

Viewed from the standpoint of controlling the aggregation rate, the dispersoid in the fine particle dispersion, considered relative to the total amount of the dispersion, is preferably at least 5 mass % and not more than 50 mass % and is more preferably at least 10 mass % and not more than 40 mass %.

(b) The Aggregation Step

After the fine particle dispersion has been prepared, an aggregated particle dispersion, in which aggregated particles formed by the aggregation of the fine particles are dispersed, is prepared by mixing one type of fine particle dispersion or by mixing two or more types of fine particle dispersions.

There are no particular limitations on the mixing method, and mixing may be carried out using a common stirring apparatus.

Aggregation may be controlled using, for example, a flocculant, the temperature and pH of the aggregated particle dispersion, and so forth, and any method may be used.

With regard to the temperature for formation of the aggregated particles, it is preferably at least the glass transition temperature of the binder resin −30° C. to not more than the glass transition temperature.

Inorganic metal salts and complexes of divalent or higher metals are examples of the flocculant. The use of an opposite-polarity surfactant is also effective when a surfactant has been used as an auxiliary agent in the fine particle dispersion. When, in particular, a metal complex is used as a flocculant, the amount of use of the surfactant may be reduced and the charging characteristics are improved. The inorganic metal salt can be exemplified by metal salts such as sodium chloride, calcium chloride, calcium nitrate, barium chloride, magnesium chloride, magnesium sulfate, zinc chloride, aluminum chloride, and aluminum sulfate, and by inorganic metal salt polymers such as polyaluminum chloride, polyaluminum hydroxide, and calcium polysulfide.

A water-soluble chelating agent may be used as the chelating agent. The chelating agent may be specifically exemplified by oxycarboxylic acids such as tartaric acid, citric acid, and gluconic acid and by iminodiacetic acid (IDA), nitrilotriacetic acid (NTA), and ethylenediaminetetraacetic acid (EDTA). The amount of addition of the chelating agent, per 100 mass parts of the resin particles, is, for example, preferably at least 0.01 mass parts and not more than 5.0 mass parts and more preferably at least 0.1 mass parts to less than 3.0 mass parts.

The timing of the mixing of the fine particle dispersion is not particularly limited, and aggregation may be carried out with the further addition of a fine particle dispersion after an aggregated particle dispersion has been formed or during the formation of an aggregated particle dispersion.

The structure in the toner can be controlled by controlling the timing of addition of fine particle dispersions.

In addition, a stirring rate-controllable stirring apparatus is preferably used in the aggregation step. There are no particular limitations on this stirring apparatus, and the stirrer apparatuses commonly used as emulsifying devices and dispersers may be used.

Examples here are batch or continuous dual-use emulsifying devices such as the ULTRA-TURRAX (IKA® Werke GmbH & Co. KG), POLYTRON (Kinematica AG), TK AUTOHOMOMIXER (Tokushu Kika Kogyo Co., Ltd.), EBARA MILDER (Ebara Corporation), TK HOMOMIC LINE FLOW (Tokushu Kika Kogyo Co., Ltd.), CLEARMIX (M Technique Co., Ltd.), and FILMICS (Tokushu Kika Kogyo Co., Ltd.).

The stirring rate may be adjusted as appropriate in conformity to the production scale.

In particular, the magnetic body, which has a high specific gravity, is readily susceptible to effects from the stirring rate. Control to the target particle diameter may be achieved by adjusting the stirring rate and stirring time. When a fast stirring rate is used, aggregation is readily promoted and magnetic body aggregation progresses and the ultimate formation of a low-brightness toner is facilitated.

When a slow stirring rate is used, the magnetic body is prone to sedimentation and the aggregated particle dispersion then becomes nonuniform and the appearance of interparticle differences in the amount of magnetic body incorporation is facilitated.

On the other hand, the state of aggregation can also be controlled by the addition of surfactant.

Aggregation is preferably stopped at the stage at which the aggregated particle has achieved the target particle diameter.

Aggregation can be stopped, for example, by dilution, control of the temperature, control of the pH, the addition of a chelating agent, the addition of a surfactant, and so forth, while the addition of a chelating agent is preferred from a production standpoint. In a more preferred method, aggregation is stopped by the addition of chelating agent and adjustment of the pH. When chelating agent addition and pH adjustment are used in combination, this can bring about the formation, once the ensuing coalescence step has been performed, of a toner particle in which the magnetic bodies are moderately aggregated.

(c) The Coalescence Step

Once the aggregated particle has been formed, the toner particle is then formed by melting and coalescence due to the application of heat.

The heating temperature is preferably equal to or greater than the glass transition temperature of the binder resin.

In addition, a toner particle having a core/shell structure may be formed by the admixture of a fine particle dispersion—after the aggregated particle has been heated and coalesced—and the additional execution of (b) the aggregated particle formation step and (c) the melting and coalescence step.

(d) The Washing and Drying Step

Known washing methods, known solid-liquid separation methods, and known drying methods may be used without particular limitation.

However, viewed in terms of the charging performance, the execution of a thorough replacement wash with deionized water is preferred in the washing step. In addition, viewed in terms of the productivity, the solid-liquid separation step is preferably executed by, for example, suction filtration or pressure filtration. Also viewed in terms of the productivity, the drying step is preferably executed by, for example, freeze drying, flash jet drying, fluidized drying, or vibrating fluidized drying.

In order to enhance the flowability and/or charging performance of the toner, the magnetic toner may be provided by mixing the magnetic toner particle with an external additive on an optional basis. A known device, for example, a Henschel mixer, may be used to mix this external additive.

The external additive can be exemplified by inorganic fine particles having a number-average primary particle diameter of at least 4 nm and not more than 80 nm, and inorganic fine particles having a number-average primary particle diameter of at least 6 nm and not more than 40 nm are an advantageous example.

The charging performance and environmental stability of the toner can be further enhanced when a hydrophobic treatment is executed on the inorganic fine particles. The treatment agent used in this hydrophobic treatment can be exemplified by silicone varnishes, variously modified silicone varnishes, silicone oils, variously modified silicone oils, silane compounds, silane coupling agents, other organosilicon compounds, and organotitanium compounds. A single one of these treatment agents may be used by itself, or two or more may be used in combination.

The number-average primary particle diameter of the inorganic fine particles may be determined using the enlarged image of the toner taken with a scanning electron microscope (SEM).

The inorganic fine particle can be exemplified by silica fine particles, titanium oxide fine particles, and alumina fine particles. For example, the dry silica known as dry-method silica or fumed silica, and produced by the vapor phase oxidation of silicon halide, and the wet silica produced from, for example, water glass, can be used for the silica fine particles.

However, dry silica is preferred because it has fewer silanol groups at the surface and in the silica fine particle interior and because it has less production residue, e.g., $Na_2O$, $SO_3^{2-}$, and so forth.

Composite fine particles of silica and another metal oxide can also by obtained during the dry silica production process by using another metal halide, e.g., aluminum chloride, titanium chloride, and so forth, in combination with the silicon halide, and these are also encompassed by dry silica.

The content of the inorganic fine particles, per 100 mass parts of the toner particle, is preferably at least 0.1 mass parts and not more than 3.0 mass parts. The inorganic fine particle content may be quantitated using an x-ray fluorescence analyzer from a calibration curve constructed using standard samples.

The magnetic toner may contain other additives within a range in which negative effects are substantially not imparted. Such additives can be exemplified by lubricant powders such as fluororesin powder, zinc stearate powder, and polyvinylidene fluoride powder; abrasives such as cerium oxide powder, silicon carbide powder, and strontium titanate powder; and anticaking agents. These additives may also be used after the execution of a hydrophobic treatment on the surface of the additive.

The volume-average particle diameter (Dv) of the magnetic toner is preferably at least 3.0 μm and not more than 8.0 μm and is more preferably at least 5.0 μm and not more than 7.0 μm.

By having the volume-average particle diameter (Dv) of the toner be in the indicated range, the dot reproducibility can be well satisfied while the toner is provided with good handling characteristics.

In addition, the number-average particle diameter (Dn) of the magnetic toner is preferably at least 3.0 μm and not more than 7.0 μm.

The ratio (Dv/Dn) of the volume-average particle diameter (Dv) of the magnetic toner to a number-average particle diameter (Dn) thereof is preferably less than 1.25.

Figure 3:
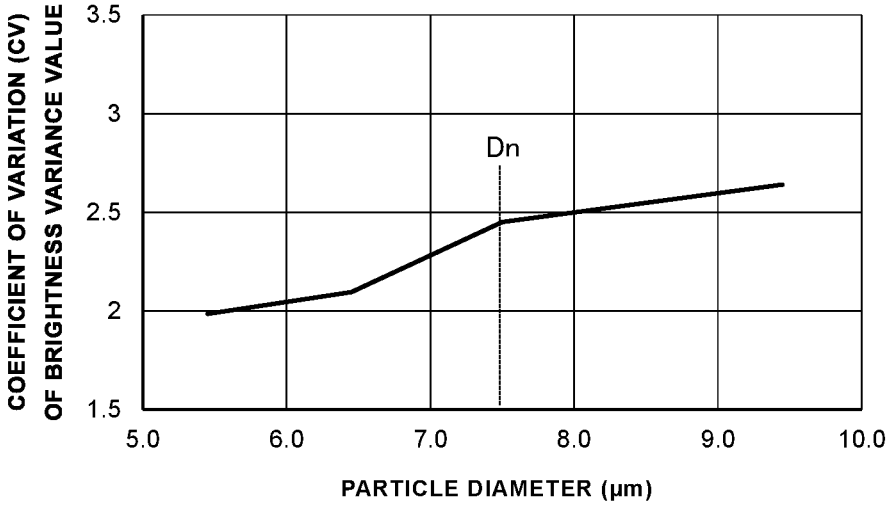
FIG. 3 is an example of the relationship between the toner particle diameter and the coefficient of variation of the brightness variance value.

An example showing the relationship between the particle diameter of a toner and its coefficient of variation of the brightness variance value is given in FIG. 3.

The average circularity of the magnetic toner is preferably at least 0.960 and not more than 1.000 and is more preferably at least 0.970 and not more than 0.990.

When the average circularity is in the indicated range, the appearance of toner consolidation is suppressed and the retention of toner flowability is facilitated—even in systems in which high shear is applied such as mono-component contact developing systems. As a result, the appearance of a decline in image density and development streaks in the latter half of a long print run can be further suppressed.

With regard to this average circularity, the circularity may be controlled by the methods ordinarily used during toner production; for example, in an emulsion aggregation method, the time in the coalescence step may be controlled and the amount of surfactant addition may be controlled.

The image-forming method according to the present invention contains a charging step of charging an electrostatic latent image bearing member by applying voltage from the exterior to a charging member;

a latent image-forming step of forming an electrostatic latent image on the charged electrostatic latent image bearing member;

a developing step of developing the electrostatic latent image with a toner carried on a toner bearing member to form a toner image on the electrostatic latent image bearing member;

a transfer step of transferring, by using an intermediate transfer member or without using an intermediate transfer member, the toner image on the electrostatic latent image bearing member to a transfer material; and a fixing step of fixing, by using a means for applying heat and pressure, the toner image that has been transferred to the transfer material, wherein the developing step is based on a mono-component contact developing system in which development is carried out by direct contact of the electrostatic latent image bearing member with the toner carried on the toner bearing member; and the toner is a magnetic toner having a magnetic toner particle containing a binder resin, a wax, and a magnetic body, and wherein, when Dn (μm) is a number-average particle diameter of the magnetic toner, CV1 (%) is coefficient of variation of a brightness variance value of the magnetic toner in a particle diameter range from at least Dn −0.500 to not more than Dn +0.500, and CV2 (%) is coefficient of variation of the brightness variance value of the magnetic toner in a particle diameter range from at least Dn −1.500 to not more than Dn −0.500, the CV1 and the CV2 satisfy a relationship in formula (1) below, an average brightness of the magnetic toner in the particle diameter range from at least Dn −0.500 to not more than Dn +0.500 is at least 30.0 and not more than 60.0, and when, in the cross section of the magnetic toner observed using a transmission electron microscope, the cross section of the magnetic toner is divided with a square grid having a side of 0.8 μm, the coefficient of variation CV3 of the occupied area percentage for the magnetic body is at least 40.0% and not more than 80.0%.

$$CV2/CV1 \leq 1.00 \quad (1)$$

This mono-component contact developing system is a developing system in which the toner bearing member and electrostatic latent image bearing member are disposed in contact with each other (abutting disposition), wherein these bearing members transport the toner through rotation thereof. A large shear is applied in the contact zone between the toner bearing member and electrostatic latent image bearing member. As a consequence, in order to obtain a high-quality image, the toner preferably has a high durability and a high flowability.

On the other hand, with regard to developing systems, mono-component developing systems provide greater potential for downsizing of the cartridge, where the developer is held, than do two-component developing systems, which use a carrier.

In addition, a contact developing system can produce a high-quality image with little toner scattering. That is, a mono-component contact developing system, which combines the two, can combine downsizing of the developing apparatus with enhanced image quality.

A mono-component contact developing system is described in detail in the following with reference to the drawings.

Figure 2:
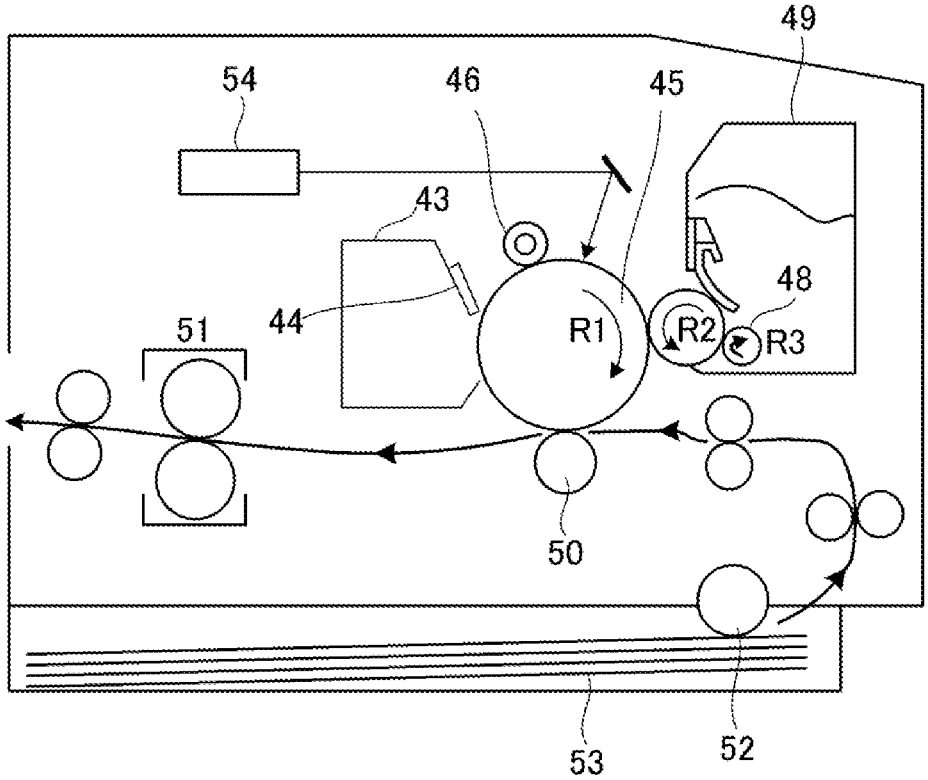
FIG. 2 is a schematic cross-sectional diagram of an image-forming apparatus that uses a mono-component contact developing system.

FIG. 1 is a schematic cross-sectional diagram that gives an example of a developing apparatus. FIG. 2 is a schematic cross-sectional diagram that gives an example of an image-forming apparatus that uses a mono-component contact developing system.

In FIG. 1 or FIG. 2, an electrostatic latent image bearing member 45, on which the electrostatic latent image is formed, is rotated in the direction of the arrow R1. Through rotation of a toner bearing member 47 in the direction of the arrow R2, toner 57 is transported into the developing zone, where the toner bearing member 47 faces the electrostatic latent image bearing member 45. In addition, a toner supply member 48 comes into contact with the toner bearing member 47 and, through rotation in the direction of the arrow R3, a toner 57 is supplied to the surface of the toner bearing member 47. The toner 57 is also stirred by a stirring member 58.

The following are disposed around the circumference of the electrostatic latent image bearing member 45: a charging member (charging roller) 46, a transfer member (transfer roller) 50, a cleaner container 43, a cleaning blade 44, a fixing unit 51, and a pick-up roller 52. The electrostatic latent image bearing member 45 is charged by the charging roller 46. In addition, exposure is carried out by irradiating the electrostatic latent image bearing member 45 with laser light from a laser generator 54, thereby forming an electrostatic latent image that corresponds to the target image. The electrostatic latent image on the electrostatic latent image bearing member 45 is developed by a toner 57 within the developing apparatus 49 to obtain a toner image. The toner image is transferred to a transfer member (paper) 53 by a transfer member (transfer roller) 50 that abuts the electrostatic latent image bearing member 45 with the transfer material interposed therebetween. Transfer of the toner image to the transfer material may also be carried out using an intermediate transfer member. The toner image-loaded transfer material (paper) 53 is carried to the fixing unit 51 and the toner image is fixed onto the transfer material (paper) 53. In addition, toner 57 remaining in part on the electrostatic latent image bearing member 45 is scraped off by the cleaning blade 44 and is stored in the cleaner container 43.

In addition, the toner layer thickness on the toner bearing member is preferably controlled by contact between a toner control member (reference sign 55 in FIG. 1) and the toner bearing member with the toner interposed therebetween. Proceeding thusly makes it possible to obtain a high quality image free of control defects. A regulating blade is generally used as the toner control member abutting the toner bearing member.

The base, which is the upper edge side of the regulating blade, is fixed and held in the developing apparatus, and contact with the surface of the toner bearing member at an appropriate elastic pressing force may be brought about by adopting a state in which the lower edge side is deflected in the forward direction or reverse direction of the toner bearing member against the elastic force of the blade.

For example, the fixing of the toner control member 55 in the developing apparatus may be carried out by sandwiching one of the free ends of the toner control member 55 between two holding members (for example, an elastic metal element, reference sign 56 in FIG. 1), as shown in FIG. 1, and fixing by screw fastening.

The methods used to measure the various property values related to the present invention are described in the following.

Method for Measuring the Volume-Average Particle Diameter (Dv) and Number-Average Particle Diameter (Dn) of the Magnetic Toner The volume-average particle diameter (Dv) and number-average particle diameter (Dn) of the magnetic toners is determined proceeding as follows.

The measurement instrument used is a "COULTER COUNTER MULTISIZER 3" (registered trademark, Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman COULTER MULTISIZER 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of approximately 1 mass % and, for example, "Isoton II" (from Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1600 μA; the gain is set to 2; the electrolyte is set to Isoton II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the aforementioned aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the aforementioned aqueous electrolyte solution is introduced into a 100-mL flatbottom glass beaker. To this is added as dispersing agent approximately 0.3 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System "TRETORA 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of deionized water is introduced into the water tank of this ultrasound disperser and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the volume-average particle diameter (Dv) and the number-average particle diameter (Dn) are calculated. When set to graph/volume % with the dedicated software, the "50% D diameter" on the "analysis/volumetric statistical value (arithmetic average)" screen is the volume-average particle diameter (Dv). When set to graph/number % with the dedicated software, the "arithmetic diameter" on the "analysis/numerical statistical value (arithmetic average)" screen is the number-average particle diameter (Dn).

Method for Measuring the Average Brightness, the Brightness Variance Value and Coefficient of Variation thereof, and the Average Circularity of the Magnetic Toner The average brightness, the brightness variance value and coefficient of variation thereof, and the average circularity of the magnetic toners are measured using an "FPIA-3000" (Sysmex Corporation), a flow-type particle image analyzer, and using the measurement and analysis conditions from the calibration process.

The specific measurement method is as follows.

First, approximately 20 mL of deionized water from which solid impurities and so forth have been preliminarily removed, is introduced into a glass container. To this is added as dispersing agent approximately 0.2 mL of a dilution prepared by the approximately three-fold (mass) dilution with deionized water of "CONTAMINON N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.). Approximately 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be at least 10° C. and not more than 40° C. Using a "VS-150" (Velvo-Clear) benchtop ultrasound cleaner/disperser that has an oscillation frequency of 50 kHz and an electrical output of 150 W as the ultrasound disperser, a prescribed amount of deionized water is introduced into the water tank and approximately 2 mL of Contaminon N is added to the water tank.

The aforementioned flow-type particle image analyzer fitted with a "LUCPLFLN" objective lens (20×, numerical aperture: 0.40) is used for the measurement, and "PSE-900A" (Sysmex Corporation) particle sheath is used for the sheath solution. The dispersion prepared according to the procedure described above is introduced into the flow-type particle image analyzer and 2,000 of the magnetic toner are measured according to total count mode in HPF measurement mode. The average brightness, brightness variance value, and average circularity of the toner are calculated from the results.

The average brightness value of the magnetic toner is the value calculated by limiting the circle-equivalent diameter of the flow-type particle image analyzer to the particle diameter range from at least Dn −0.500 (μm) to not more than Dn +0.500 (μm) based on the results for the number-average particle diameter (Dn) of the magnetic toner.

CV1 is the value calculated for the coefficient of variation of the brightness variance value for the results of measurement of the brightness variance value with the circle-equivalent diameter of the flow-type particle image analyzer limited to the range from at least Dn −0.500 (μm) to not more than Dn +0.500 (μm) based on the results for the number-average particle diameter (Dn) of the magnetic toner.

CV2 is the value calculated for the coefficient of variation of the brightness variance value for the results of measurement of the brightness variance value with the circle-equivalent diameter of the flow-type particle image analyzer limited to the range from at least Dn −1.500 (μm) to not more than Dn −0.500 (μm) based on the results for the number-average particle diameter (Dn) of the magnetic toner.

For this measurement, automatic focal point adjustment is performed prior to the start of the measurement using reference latex particles (a dilution with deionized water of "Research and Test Particles Latex Microsphere Suspensions 5100A", Duke Scientific Corporation). After this, focal point adjustment is preferably performed every two hours after the start of measurement.

The flow-type particle image analyzer used herein had been calibrated by the Sysmex Corporation and had been issued a calibration certificate by the Sysmex Corporation.

The measurements are carried out under the same measurement and analysis conditions as when the calibration certification was received, with the exception that the analyzed particle diameter was limited to a circle-equivalent diameter of at least 1.977 μm and less than 39.54 μm.

Method for Measuring the Melting Point

The melting point of the resin and wax is measured under the following conditions using a Q2000 (TA Instruments) differential scanning calorimeter (DSC).

ramp rate: 10° C./min
measurement start temperature: 20° C.
measurement end temperature: 180° C.

Temperature correction in the instrument detection section is performed using the melting points of indium and zinc, and the amount of heat is corrected using the heat of fusion of indium.

Specifically, approximately 5 mg of the sample is exactly weighed out and is introduced into an aluminum pan and the measurement is carried out one time. An empty aluminum pan is used as the reference. The peak temperature of the maximum endothermic peak here is taken to be the melting point.

Method for Measuring the Glass Transition Temperature (Tg)

Using the reversing heat flow curve during ramp up obtained in the aforementioned differential calorimetric measurement of the melting point, the glass transition temperature of, for example, the resins, is the temperature (° C.) at the point of intersection between the curve for the step-shaped change region at the glass transition in the reversing heat flow curve, and the straight line that is equidistant in the vertical axis direction from the straight lines that extend the baselines for prior to and subsequent to the appearance of the change in the specific heat.

Method for Measuring the Number-Average Molecular Weight (Mn) and Weight-Average Molecular Weight (Mw) of, e.g., the Resins The number-average molecular weight (Mn) and the weight-average molecular weight (Mw) of the resins and other substances are measured as follows using gel permeation chromatography (GPC).

(1) Preparation of the Measurement Sample

The sample and tetrahydrofuran (THF) are mixed to give a concentration of 5.0 mg/mL; standing is carried out for 5 to 6 hours at room temperature; and thorough shaking is then performed and the THF and sample are well mixed until sample aggregates are not present. Standing at quiescence is carried out for at least an additional 12 hours. The time from the start of mixing of the sample with the THF until the completion of standing at quiescence is made at least 72 hours, thus yielding the tetrahydrofuran (THF)-soluble matter of the sample.

This is followed by filtration with a solvent-resistant membrane filter (pore size=0.45 to 0.50 μm, H-25-2 Sample Pretreatment Cartridge, Tosoh Corporation) to obtain a sample solution.

(2) Measurement of the Sample

The measurement is run using the following conditions and the obtained sample solution.

instrument: LC-GPC 150C high-performance GPC instrument (Waters Corporation)
columns: 7-column train of Shodex GPC KF-801, 802, 803, 804, 805, 806, and 807 (Showa Denko K.K.)
mobile phase: THF
flow rate: 1.0 mL/min
column temperature: 40° C.
sample injection amount: 100 μL
detector: RI (refractive index) detector With regard to measurement of the sample molecular weight, the molecular weight distribution is determined from the relationship between the number of counts and the logarithmic value from a calibration curve constructed using a plurality of monodisperse polystyrene standard samples.

The molecular weights of the polystyrene standard samples (Pressure Chemical Company or Tosoh Corporation) used to construct the calibration curve are as follows: $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$.

Method for Measuring the Particle Diameter of the Dispersed Material in the Fine Particle Dispersion The particle diameter of the dispersed material in each fine particle dispersion was measured using a laser diffraction/scattering particle size distribution analyzer. Specifically, the measurement is carried out based on JIS Z 8825-1 (2001).

An "LA-920" (Horiba, Ltd.) laser diffraction/scattering particle size distribution analyzer is used as the measurement instrument.

The "Horiba LA-920 for Windows (registered trademark) Wet (LA-920) Ver. 2.02" dedicated software provided with the LA-920 is used to set the measurement conditions and analyze the measurement data. Deionized water from which, for example, solid impurities and so forth have been removed in advance is used as the measurement solvent. The measurement procedure is as follows.

(1) A batch cell holder is installed in the LA-920.

(2) A prescribed amount of deionized water is introduced into a batch cell and the batch cell is set into the batch cell holder.

(3) Stirring is performed in the batch cell using the provided stirrer chip.

(4) The "refractive index" button on the "condition setting display" screen is pressed and the relative refractive index is set to the value corresponding to the fine particles.

(5) The particle diameter basis is set to a volume basis on the "condition setting display" screen.

(6) After warming up for at least one hour, optical axis adjustment, optical axis fine adjustment, and measurement of the blank are carried out.

(7) 3 mL of the fine particle dispersion is introduced into a 100-mL flatbottom glass beaker. The resin fine particle dispersion is diluted by introducing 57 mL of deionized water. To this is added as dispersing agent 0.3 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(8) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of deionized water is introduced into the water tank of this ultrasound disperser and 2 mL of Contaminon N is added to this water tank.

(9) The beaker described in (7) is set into the beaker holder opening on the ultrasound disperser and the ultrasound disperser is started. The vertical position of the beaker is adjusted in such a manner that the resonance condition of the surface of the aqueous solution within the beaker is at a maximum.

(10) The ultrasound dispersion treatment is continued for 60 seconds. The water temperature in the water tank is controlled as appropriate during ultrasound dispersion to be at least 10° C. and not more than 40° C.

(11) The fine particle dispersion prepared at (10) is immediately added in small portions to the batch cell while taking care to avoid the introduction of bubbles, with adjustment to provide a transmittance with a tungsten lamp of 90% to 95%. The particle size distribution is then measured. The particle diameter of the dispersed material in the fine particle dispersion is calculated based on the obtained volume-based particle size distribution data.

Method for Determining the Occupied Area Percentage for the Magnetic Body in the Magnetic Toner and Coefficient of Variation (CV3) Thereof The occupied area percentage for the magnetic body in the magnetic toner and coefficient of variation (CV3) thereof are determined as follows.

First, an image of the cross section of the magnetic toner is acquired using a transmission electron microscope (TEM). Based on the partitioning of the obtained cross section image, a frequency histogram is obtained of the occupied area percentage for the magnetic body in each grid section.

In addition, the coefficient of variation of the obtained occupied area percentage for each grid section is determined and is used as the coefficient of variation (CV3) of the occupied area percentage.

Specifically, a tablet is first prepared by compression molding of the magnetic toner. 100 mg of the magnetic toner is filled into a tablet molder having a diameter of 8 mm, and a tablet is obtained by the application of a force of 35 kN and holding for 1 minute.

The obtained tablet is sectioned using an ultrasound ultramicrotome (UC7, Leica Microsystems GmbH) to obtain a thin-section sample having a film thickness of 250 nm.

An STEM image of the obtained thin-section sample is acquired using a transmission electron microscope (JEM2800, JEOL Ltd.).

A probe size of 1.0 nm and an image size of 1024×1024 pixels are used to acquire the STEM image. Here, the magnetic body region alone can be acquired as dark by adjusting the Contrast to 1425 and the Brightness to 3750 on the Detector Control panel for the bright-field image and adjusting the Contrast to 0.0, the Brightness to 0.5, and the Gamma to 1.00 on the Image Control panel. An STEM image favorable for image processing is obtained using these settings.

The obtained STEM image is digitized using an image processor (LUZEX AP, Nireco Corporation).

Specifically, a frequency histogram is obtained for the occupied area percentage for the magnetic body in a square grid having a side of 0.8 μm as provided by the partitioning procedure. The class width for this histogram is 5%.

In addition, the coefficient of variation is determined from the obtained occupied area percentage for each grid section and is used as the coefficient of variation CV3 of the occupied area percentage. The average value of the occupied area percentage is the average of the occupied area percentages for the individual grid sections.

Method for Determining the Number-Average Diameter of the Wax Domains

The magnetic toner is embedded using a visible light-curable embedding resin (D-800, Nisshin EM Co., Ltd.); sectioning to a thickness of 60 nm is performed using an ultrasound ultramicrotome (EMS, Leica Microsystems GmbH); and Ru staining is carried out using a vacuum stainer (Filgen, Inc.).

This is followed by observation of the obtained magnetic toner particle cross section using a transmission electron microscope (H7500, Hitachi High-Technologies Corporation) at an acceleration voltage of 120 kV.

Of the observed magnetic toner particle cross sections, 10 are selected that are within ±2.0 μm from the number-average particle diameter of the magnetic toner particle and these are imaged to obtain cross section images.

Since the wax is less strongly stained by Ru than the amorphous resin and magnetic body, it can be observed as white in the cross section image.

For the number-average diameter of the wax domains, 30 wax domains having a major axis of at least 20 nm are randomly selected in the cross section image; the average value of the major axis and minor axis is taken to be the domain diameter; and the average value of the 30 is taken to be the number-average diameter of the domains. The domains do not have to be selected from the same toner particle.

Method for Determining Ws and Wc

The state of distribution of the wax in the magnetic toner is evaluated by calculating Ws and Wc from the wax domain areas in the aforementioned cross section images; the average values for 10 randomly selected magnetic toners are used for the evaluation. The cross section images are subjected to the "Threshold" processing under "Adjustments" using image processing software (Photoshop 5.0, Adobe).

The threshold is set using the offset gradation on the low gradation side of the gradation peak indicating the binder resin in the 255-gradation distribution of the image. This threshold processing yields an image in which demarcation between the wax domains and binder resin regions is emphasized.

Using this cross section image, masking is performed leaving the region within 1.0 μm (including the 1.0 μm boundary) from the contour of the cross section, and the occupied area percentage for wax domains having a major axis of at least 20 nm in the obtained region within 1.0 μm is calculated as the occupied area percentage for the wax and is used as Ws.

On the other hand, the occupied area percentage for wax domains having a major axis of at least 20 nm and residing in the interior region positioned further toward inside than inside 1.0 μm away from the contour of the cross section is calculated as the occupied area percentage for the wax and is used as Wc.

EXAMPLES

The present invention is described in additional detail using the examples and comparative examples that follow, but the present invention is in no way limited to or by these. Unless specifically indicated otherwise, the number of parts and % in the examples and comparative examples are on a mass basis in all instances.

Polyester 1 Production Example

| | |
|---|---|
| terephthalic acid | 30.0 parts |
| isophthalic acid | 12.0 parts |
| dodecenylsuccinic acid | 40.0 parts |
| trimellitic acid | 4.2 parts |
| bisphenol A/ethylene oxide adduct (2 mol) | 80.0 parts |
| bisphenol A/propylene oxide adduct (2 mol) | 74.0 parts |
| dibutyltin oxide | 0.1 parts |

These materials were introduced into a heat-dried two-neck flask; nitrogen gas was introduced into the vessel; and the temperature was raised while stirring and maintaining the inert atmosphere. This was followed by running a condensation polymerization reaction for approximately 12 hours at 150° C. to 230° C. and then gradually reducing the pressure at 210° C. to 250° C. to obtain polyester 1.

Polyester 1 had a number-average molecular weight (Mn) of 18,200, a weight-average molecular weight (Mw) of 74,100, and a glass transition temperature (Tg) of 58.6° C.

Resin Particle Dispersion 1 Production Example 100.0 parts of ethyl acetate, 30.0 parts of polyester 1, 0.3 parts of 0.1 mol/L sodium hydroxide, and 0.2 parts of an anionic surfactant (NEOGEN RK, DKS Co. Ltd.) were introduced into a stirrer-equipped beaker and were heated to 60.0° C. Stirring was continued until complete dissolution had been achieved to prepare a resin solution 1.

While further stirring this resin solution 1, 120.0 parts of deionized water was gradually added and phase inversion emulsification was induced, and a resin particle dispersion 1 (solids concentration: 20.0 mass %) was obtained by removing the solvent.

The volume-average particle diameter of the resin particles in resin particle dispersion 1 was 0.18 μm.

Resin Particle Dispersion 2 Production Example

| | |
|---|---|
| styrene | 78.0 parts |
| n-butyl acrylate | 20.0 parts |
| β-carboxyethyl acrylate | 2.0 parts |
| 1,6-hexanediol diacrylate | 0.4 parts |
| dodecanethiol (Wako Pure Chemical Industries, Ltd.) | 0.7 parts |

These materials were introduced into a flask and were mixed and dissolved to obtain a solution.

The obtained solution was dispersed and emulsified in an aqueous medium prepared by the dissolution of 1.0 parts of an anionic surfactant (NEOGEN RK, DKS Co. Ltd.) in 250 parts of deionized water.

2 parts of ammonium persulfate dissolved in 50 parts of deionized water was also introduced while gently stirring and mixing over 10 minutes.

Then, after thorough substitution of the interior of the system with nitrogen, heating was carried out on an oil bath while stirring until the system interior reached 70° C., and an emulsion polymerization was continued in this state for 5 hours to obtain a resin particle dispersion 2 (solids concentration: 25.0 mass %).

The volume-average particle diameter of the resin particles in the resin particle dispersion 2 was 0.18 μm, the glass transition temperature (Tg) was 56.5° C., and the weight-average molecular weight (Mw) was 30,000.

Wax Dispersion 1 Production Example

| | |
|---|---|
| paraffin wax (HNP-9, Nippon Seiro Co., Ltd.) | 50.0 parts |
| anionic surfactant (NEOGEN RK, DKS Co. Ltd.) | 0.3 parts |
| deionized water | 150.0 parts |

The preceding were mixed and heated to 95° C. and were dispersed using a homogenizer (ULTRA-TURRAX T50, IKA®-Werke GmbH & Co. KG). This was followed by dispersion processing with a Manton-Gaulin high-pressure homogenizer (Gaulin) to prepare a wax dispersion 1 (solids concentration: 25.0 mass %) in which wax particles were dispersed. The volume-average particle diameter of the obtained wax particles was 0.20

Wax Dispersions 2 and 3 Production Example

Wax dispersions 2 and 3 were obtained by appropriate adjustments of the dispersion processing time and amount of surfactant addition in Wax Dispersion 1 Production Example. The volume-average particle diameter of the wax particles in each wax dispersion is given in Table 1.

TABLE 1

| | Volume-average particle diameter of the wax particles (μm) |
|---|---|
| Wax dispersion 1 | 0.20 |
| Wax dispersion 2 | 0.15 |
| Wax dispersion 3 | 0.30 |

Magnetic Body 1 Production Example 55 liters of a 4.0 mol/L aqueous sodium hydroxide solution was mixed with stirring into 50 liters of an aqueous ferrous sulfate solution containing $Fe^{2+}$ at 2.0 mol/L to obtain an aqueous ferrous salt solution that contained colloidal ferrous hydroxide. An oxidation reaction was run while holding this aqueous solution at 85° C. and blowing in air at 20 L/min to obtain a slurry that contained core particles.

The obtained slurry was filtered and washed on a filter press, after which the core particles were redispersed in water. To this reslurried liquid was added sodium silicate to provide 0.20 mass % as silicon per 100 parts of the core particles; the pH of the slurry was adjusted to 6.0; and magnetic iron oxide particles having a silicon-rich surface were obtained by stirring.

The obtained slurry was filtered and washed with a filter press and was reslurried with deionized water. Into this reslurried liquid (solids fraction=50 parts/L) was introduced 500 parts (10 mass % relative to the magnetic iron oxide) of the ion-exchange resin SK110 (Mitsubishi Chemical Corporation) and ion-exchange was carried out for 2 hours with stirring. This was followed by removal of the ion-exchange resin by filtration on a mesh; filtration and washing on a filter press; and drying and crushing to obtain a magnetic body 1 having a number-average primary particle diameter of 0.21 μm.

Magnetic Body 2 and Magnetic Body 3 Production Example

Magnetic body 2 and magnetic body 3 were obtained proceeding as in the Magnetic Body 1 Production Example, but adjusting the amount of air injection and the oxidation reaction time. The number-average particle diameter of the primary particles of each magnetic body is given in Table 2.

TABLE 2

| | Number-average particle diameter of primary particles (μm) |
|---|---|
| Magnetic body 1 | 0.21 |
| Magnetic body 2 | 0.15 |
| Magnetic body 3 | 0.30 |

Magnetic Body Dispersion 1 Production Example

| | |
|---|---|
| magnetic body 1 | 25.0 parts |
| deionized water | 75.0 parts |

These materials were mixed and were dispersed for 10 minutes at 8,000 rpm using a homogenizer (ULTRA-TURRAX T50, IKA®-Werke GmbH & Co. KG) to obtain a magnetic body dispersion 1. The volume-average particle diameter of the magnetic body in magnetic body dispersion 1 was 0.23 μm.

Magnetic Body Dispersions 2 and 3 Production Example

Magnetic body dispersions 2 and 3 were produced proceeding as in Magnetic Body Dispersion 1 Production Example, but changing magnetic body 1 to magnetic body 2 or magnetic body 3. The volume-average particle diameter of the magnetic body in the obtained magnetic body dispersion 2 was 0.18 μm, and the volume-average particle diameter of the magnetic body in magnetic body dispersion 3 was 0.35 μm.

Magnetic Toner Particle 1 Production Example

| | |
|---|---|
| resin particle dispersion 1 (solids fraction = 20.0 mass %) | 150.0 parts |
| wax dispersion 1 (solids fraction = 25.0 mass %) | 15.0 parts |
| magnetic body dispersion 1 (solids fraction = 25.0 mass %) | 105.0 parts |

These materials were introduced into a beaker, and, after adjustment to bring the total number of parts of water to 250 parts, heating was carried out to 30.0° C. This was followed by mixing by stirring for 1 minute at 5,000 rpm using a homogenizer (ULTRA-TURRAX T50, IKA®-Werke GmbH & Co. KG).

10.0 parts of a 2.0 mass % aqueous solution of magnesium sulfate was gradually added as a flocculant.

The starting dispersion was transferred to a polymerization kettle equipped with a stirring device and a thermometer, and aggregated particle growth was promoted by stirring and heating to 50.0° C. using a mantle heater.

At the stage at which 60 minutes had elapsed, an aggregated particle dispersion 1 was prepared by the addition of 200.0 parts of a 5.0 mass % aqueous solution of ethylenediaminetetraacetic acid (EDTA).

The pH of the aggregated particle dispersion 1 was then adjusted to 8.0 using a 0.1 mol/L aqueous sodium hydroxide solution, followed by heating the aggregated particle dispersion 1 to 80.0° C. and holding for 180 minutes to perform coalescence of the aggregated particle.

After the 180 minutes had elapsed, the result was a toner particle dispersion 1 in which toner particles were dispersed. After cooling at a ramp down rate of 1.0° C./minute, the toner particle dispersion 1 was filtered and throughflow washed with deionized water, and, when the conductivity of the filtrate reached to 50 mS or below, the toner particle cake was recovered.

The toner particle cake was then introduced into an amount of deionized water that was 20-times the mass of the toner particles; stirring was performed using a Three-One motor; and, once the toner particles had been thoroughly disaggregated, filtration, throughflow washing with water, and solid-liquid separation were again performed. The resulting toner particle cake was broken up with a sample mill followed by drying for 24 hours in a 40° C. oven. The resulting powder was again broken up with a sample mill followed by a supplemental vacuum drying for 5 hours in a 40° C. oven to obtain a magnetic toner particle 1.

Magnetic Toner 1 Production Example 0.3 parts of sol-gel silica fine particles having a number-average primary particle diameter of 115 nm was added to 100 parts of magnetic toner particle 1 and mixing was performed using an FM mixer (Nippon Coke & Engineering Co., Ltd.).

This was followed by the addition of 0.9 parts of hydrophobic silica fine particles having a post-treatment BET specific surface area of 120 $m^2/g$ and provided by treating silica fine particles having a number-average primary particle diameter of 12 nm with hexamethyldisilazane followed by treatment with silicone oil; mixing as before with an FM mixer (Nippon Coke & Engineering Co., Ltd.) gave a magnetic toner 1.

The following results are given in Table 4 for the obtained magnetic toner 1:

the volume-average particle diameter (Dv), the number-average particle diameter (Dn), the average brightness in the particle diameter range from at least Dn −0.500 to not more than Dn +0.500 (designated simply as the average brightness in the table), CV1, CV2/CV1, the average value of the occupied area percentage for the magnetic body (designated as A in the table), the average circularity, and the number-average diameter of the wax domains (designated as B in the table).

Example 1

The Image-Forming Apparatus

A LASERJET PRO M12 (Hewlett-Packard Company), which has a mono-component contact developing system, was used after modification to 200 mm/sec, which is faster than original process speed thereof.

100 g of the magnetic toner 1 was filled into the thusly modified apparatus and repetitive use tests were run in, respectively, a low-temperature, low-humidity environment (15.0° C./10.0% RH) and a high-temperature, high-humidity environment (32.5° C./80% RH).

For the output image for the tests, 4,000 prints were output of a horizontal line image having a print percentage of 1%, using a two-sheet intermittent paper feed.

The evaluation paper used in the tests was Business 4200 (Xerox Corporation), which has an areal weight of 75 $g/m^2$.

The results of the evaluations are given in Table 5. The evaluation method and evaluation criteria for each evaluation are described in the following.

Evaluation of the Image Density in the Low-Temperature, Low-Humidity Environment With regard to the image density, a solid black image region was formed and the density of this solid black image was measured using a Macbeth reflection densitometer (GretagMacbeth GmbH).

The criteria for evaluating the reflection density of the solid black image prior to the durability test are given below.

Evaluation Criteria

A: at least 1.45

B: at least 1.40 and less than 1.45

C: at least 1.35 and less than 1.40

D: less than 1.35

The criteria for evaluating the change in the image density in the latter half of the durability test are given below.

Here, better results are indicated by a smaller difference between the reflection density of the solid black image prior to the durability test and the reflection density of the solid black image output after the aforementioned 4000-print repetitive use test.

Evaluation Criteria

A: the density difference is less than 0.10

B: the density difference is at least 0.10 and less than 0.15

C: the density difference is at least 0.15 and less than 0.20

D: the density difference is at least 0.20

Evaluation of Fogging in a Low-Temperature, Low-Humidity Environment

The fogging was measured using a REFLECTOMETER Model TC-6DS from Tokyo Denshoku Co., Ltd. A green filter was used for the filter.

To carry out the evaluation, a solid black image was first output after the aforementioned 4000-print repetitive use test.

Immediately after transfer of the solid black image, MYLAR film tape was taped to and peeled off the region of the electrostatic latent image bearing member that corresponded to a white background region (nonimage area), and the MYLAR tape was then pasted on paper.

The fogging value was taken to be the difference yielded by subtracting the reflection percentage when only the MYLAR tape was applied to virgin paper, from the reflection percentage when the peeled-off MYLAR tape was applied to virgin paper.

Evaluation Criteria

A: less than 5.0%

B: at least 5.0% and less than 10.0%

C: at least 10.0% and less than 15.0%

D: at least 15.0%

Evaluation of Development Streaks in the High-Temperature, High-Humidity Environment For the presence/absence of vertical streaks caused by the melt adhesion of toner to the control member, i.e., for the presence/absence of the production of development streaks, the output of a solid black image was performed after the aforementioned 4000-print repetitive use test, and checking was carried out visually every 100 prints.

Evaluation Criteria

A: no production even at 2,000 prints

B: production at more than 1,000 prints, but at or below 2,000 prints

C: production at more than 500 prints, but at or below 1,000 prints

D: production at or below 500 prints

Magnetic Toner Particle 2 Production Example

Pre-Aggregation Step

| | |
|---|---|
| magnetic body dispersion 1 (solids fraction = 25.0 mass %) | 105.0 parts |

This material was introduced into a beaker and the temperature was brought to 30.0° C. This was followed by stirring for 1 minute at 5,000 rpm using a homogenizer (ULTRA-TURRAX T50, IKA®-Werke GmbH & Co. KG) and by the gradual addition of 1.0 parts of a 2.0 mass % aqueous solution of magnesium sulfate as a flocculant with stirring for 1 minute.

Aggregation Step

| | |
|---|---|
| resin particle dispersion 1 (solids fraction = 25.0 mass %) | 150.0 parts |
| wax dispersion 1 (solids fraction = 25.0 mass %) | 15.0 parts |

These materials were introduced into the aforementioned beaker, and, after adjustment to bring the total number of parts of water to 250 parts, mixing was carried out by stirring for 1 minute at 5,000 rpm.

In addition, 9.0 parts of a 2.0 mass % aqueous solution of magnesium sulfate was gradually added as a flocculant.

The starting dispersion was transferred to a polymerization kettle equipped with a stirring device and a thermometer, and aggregated particle growth was promoted by stirring and heating to 50.0° C. using a mantle heater.

At the stage at which 59 minutes had elapsed, an aggregated particle dispersion 2 was prepared by the addition of 200.0 parts of a 5.0 mass % aqueous solution of ethylenediaminetetraacetic acid (EDTA).

The pH of the aggregated particle dispersion 2 was then adjusted to 8.0 using a 0.1 mol/L aqueous sodium hydroxide solution, followed by heating the aggregated particle dispersion 2 to 80.0° C. and holding for 180 minutes to perform coalescence of the aggregated particle.

After the 180 minutes had elapsed, the result was a toner particle dispersion 2 in which toner particles were dispersed. After cooling at a ramp down rate of 1.0° C./minute, the toner particle dispersion 2 was filtered and throughflow washed with deionized water, and, when the conductivity of the filtrate reached to 50 mS or below, the toner particle cake was recovered. The toner particle cake was then introduced into an amount of deionized water that was 20-times the mass of the toner particles; stirring was performed using a Three-One motor; and, once the toner particles had been thoroughly disaggregated, filtration, throughflow washing with water, and solid-liquid separation were again performed. The resulting toner particle cake was broken up with a sample mill followed by drying for 24 hours in a 40° C. oven. The resulting powder was again broken up with a sample mill followed by a supplemental vacuum drying for 5 hours in a 40° C. oven to obtain a magnetic toner particle 2.

Magnetic Toner Particles 3 to 24 Production Example

Magnetic toner particles 3, 5, 7 to 9, 11 to 21, and 24 were obtained proceeding as in the Magnetic Toner Particle 1 Production Example, but changing to the conditions given in Table 3.

Magnetic toner particles 4, 6, 10, 22, and 23 were obtained, on the other hand, proceeding as in the Magnetic Toner Particle 2 Production Example, but changing to the conditions given in Table 3.

In the production examples for magnetic toner particles 3, 5, 7, and 11, in a first aggregation step, the flocculant was added after the addition of 0.2 parts surfactant (Noigen TDS-200, DKS Co., Ltd.).

In the production examples for magnetic toner particles 6, 7, 14, and 15, after the first aggregation step, in which aggregated particle growth was promoted at 50.0° C., the dispersion indicated in Table 3 was added and a second aggregation step, in which aggregated particle growth was again promoted at 50.0° C., was performed.

In the production examples for magnetic toner particles 20 and 21, after the first aggregation step, in which aggregated particle growth was promoted at 50.0° C., the dispersion indicated in Table 3 was added and the second aggregation step, in which aggregated particle growth was again promoted at 50.0° C., was performed. This was followed by the addition of the dispersion indicated in Table 3 and the execution of a third aggregation step, in which aggregated particle growth was again promoted at 50.0° C.

TABLE 3

| | Pre-aggregation | | | | First aggregation step | | | | | | Second aggregation step | | | Third aggregation step | | | Coalescence step | | |
|---|---|---|---|---|---|---|---|---|---|---|---|---|---|---|---|---|---|---|---|
| Magnetic toner particle No. | Type of dispersion | Number of parts of addition (parts) | Number of parts of flocculant addition (parts) | Aggregation time (min) | Type of dispersion | Number of parts of addition (parts) | Surfactant | Number of parts of addition (parts) | Number of parts of flocculant addition (parts) | Aggregation time (min) | Type of dispersion | Number of parts of addition (parts) | Aggregation time (min) | Type of dispersion | Number of parts of addition (parts) | Aggregation time (min) | Number of parts of EDTA addition (parts) | pH | Coalescence time (min) |
| 1 | — | | — | — | Resin particle dispersion 1<br>Wax dispersion 1<br>Magnetic body | 150.0<br>15.0<br>105.0 | — | — | 10.0 | 60 | — | — | — | — | — | — | 200 | 8.0 | 180 |
| 2 | Magnetic body dispersion 1 | 105.0 | 1.0 | 1 | Wax dispersion 1<br>Resin particle dispersion 1 | 15.0<br>150.0 | — | — | 9.0 | 59 | — | — | — | — | — | — | 200 | 8.0 | 180 |
| 3 | — | | — | — | Resin particle dispersion 1<br>Wax dispersion 1<br>Magnetic body dispersion 1 | 150.0<br>15.0<br>105.0 | Noigen | 0.2 | 10.0 | 60 | — | — | — | — | — | — | 150 | 10.0 | 180 |
| 4 | Magnetic body dispersion 1 | 105.0 | 1.0 | 1 | Wax dispersion 1<br>Resin particle dispersion 1 | 15.0<br>105.0 | — | — | 9.0 | 89 | — | — | — | — | — | — | 200 | 8.0 | 180 |
| 5 | — | | — | — | Resin particle dispersion 1<br>Wax dispersion 1<br>Magnetic body dispersion 2 | 150.0<br>15.0<br>105.0 | Noigen | 0.2 | 10.0 | 60 | — | — | — | — | — | — | 150 | 10.0 | 180 |
| 6 | Magnetic body dispersion 1 | 105.0 | 1.0 | 1 | Resin particle dispersion 1 | 150.0 | — | — | 9.0 | 9 | Wax dispersion 1 | 15.0 | 60 | — | — | — | 200 | 8.0 | 180 |
| 7 | — | | — | — | Resin particle dispersion 1<br>Magnetic body dispersion 1 | 150.0<br>105.0 | Noigen | 0.2 | 10.0 | 10 | Wax dispersion 1 | 150.0 | 50 | — | — | — | 150 | 10.0 | 180 |
| 8 | — | | — | — | Resin particle dispersion 1<br>Wax dispersion 1<br>Magnetic body dispersion 1 | 150.0<br>15.0<br>80.0 | — | — | 10.0 | 60 | — | — | — | — | — | — | 200 | 8.0 | 180 |
| 9 | — | | — | — | Resin particle dispersion 1<br>Wax dispersion 1<br>Magnetic body dispersion 1 | 150.0<br>15.0<br>150.0 | — | — | 10.0 | 60 | — | — | — | — | — | — | 150 | 10.0 | 180 |
| 10 | Magnetic body dispersion | 105.0 | 1.0 | 1 | Resin particle dispersion 1<br>Wax dispersion 1 | 150.0<br>15.0 | — | — | 9.0 | 59 | — | — | — | — | — | — | 200 | 8.0 | 180 |

TABLE 3-continued

| Magnetic toner particle No. | Pre-aggregation | | | | First aggregation step | | | | | | Second aggregation step | | | Third aggregation step | | | Coalescence step | | |
|---|---|---|---|---|---|---|---|---|---|---|---|---|---|---|---|---|---|---|---|
| | Type of dispersion | Number of parts of addition (parts) | Number of parts of flocculant addition (parts) | Aggregation time (min) | Type of dispersion | Number of parts of addition (parts) | Surfactant | Number of parts of addition (parts) | Number of parts of flocculant addition (parts) | Aggregation time (min) | Type of dispersion | Number of parts of addition (parts) | Aggregation time (min) | Type of dispersion | Number of parts of addition (parts) | Aggregation time (min) | Number of parts of EDTA addition (parts) | pH | Coalescence time (min) |
| | 2 | | | | | | | | | | | | | | | | | | |
| 11 | — | | — | — | Resin particle dispersion 1<br>Wax dispersion 1<br>Magnetic body dispersion 2 | 150.0<br>15.0<br>150.0 | Noigen | 0.2 | 10.0 | 60 | — | — | — | — | — | — | 150 | 10.0 | 180 |
| 12 | — | | — | — | Resin particle dispersion 1<br>Wax dispersion 1<br>Magnetic body dispersion 3 | 150.0<br>15.0<br>105.0 | — | — | 10.0 | 60 | — | — | — | — | — | — | 200 | 8.0 | 180 |
| 13 | — | | — | — | Resin particle dispersion 1<br>Wax dispersion 1<br>Magnetic body dispersion 3 | 150.0<br>15.0<br>150.0 | — | — | 10.0 | 60 | — | — | — | — | — | — | 200 | 8.0 | 180 |
| 14 | — | | — | — | Resin particle dispersion 1<br>Wax dispersion 1 | 150.0<br>15.0 | — | — | 10.0 | 30 | Magnetic body dispersion 1 | 150.0 | 30 | — | — | — | 200 | 8.0 | 180 |
| 15 | — | | — | — | Resin particle dispersion 1<br>Wax dispersion 1 | 150.0<br>15.0 | — | — | 10.0 | 30 | Magnetic body dispersion 1 | 150.0 | 30 | — | — | — | 150 | 10.0 | 180 |
| 16 | — | | — | — | Resin particle dispersion 1<br>Wax dispersion 2<br>Magnetic body dispersion 1 | 150.0<br>15.0<br>105.0 | — | — | 10.0 | 60 | — | — | — | — | — | — | 200 | 8.0 | 180 |
| 17 | — | | — | — | Resin particle dispersion 1<br>Wax dispersion 3<br>Magnetic body dispersion 1 | 150.0<br>15.0<br>105.0 | — | — | 10.0 | 60 | — | — | — | — | — | — | 200 | 8.0 | 180 |
| 18 | — | | — | — | Resin particle dispersion 1<br>Wax dispersion 1<br>Magnetic body dispersion 1 | 150.0<br>15.0<br>105.0 | — | — | 10.0 | 60 | — | — | — | — | — | — | 200 | 8.0 | 150 |
| 19 | — | | — | — | Resin particle dispersion 1<br>Wax dispersion 1<br>Magnetic body dispersion 1 | 150.0<br>15.0<br>105.0 | — | — | 10.0 | 60 | — | — | — | — | — | — | 200 | 8.0 | 120 |
| 20 | — | | — | — | Resin particle | 130.0 | — | — | 10.0 | 20 | Wax | 15.0 | 20 | Resin | 20.0 | 20 | 200 | 8.0 | 180 |

TABLE 3-continued

| | Pre-aggregation | | | | First aggregation step | | | | | | Second aggregation step | | | Third aggregation step | | | Coalescence step | | |
|---|---|---|---|---|---|---|---|---|---|---|---|---|---|---|---|---|---|---|---|
| Magnetic toner particle No. | Type of dispersion | Number of parts of addition (parts) | Number of parts of flocculant addition (parts) | Aggre-gation time (min) | Type of dispersion | Number of parts of addition (parts) | Surfactant | Number of parts of addition (parts) | Number of parts of flocculant addition (parts) | Aggre-gation time (min) | Type of dispersion | Number of parts of addition (parts) | Aggre-gation time (min) | Type of dispersion | Number of parts of addition (parts) | Aggre-gation time (min) | Number of parts of EDTA addition (parts) | pH | Coales-cence time (min) |
| | | | | | dispersion 1<br>Magnetic body dispersion 1 | 105.0 | | | | | dispersion 1 | | | particle dispersion 1 | | | | | |
| 21 | — | | — | — | Resin particle dispersion 1<br>Magnetic body dispersion 1 | 130.0<br>105.0 | — | — | 10.0 | 40 | Wax dispersion 1 | 15.0 | 10 | Resin particle dispersion 1 | 20.0 | 10 | 200 | 8.0 | 180 |
| 22 | Wax dispersion 1 | 15.0 | 1.0 | 1 | Resin particle dispersion 1<br>Magnetic body dispersion 1 | 150.0<br>105.0 | — | — | 9.0 | 59 | — | — | — | — | — | — | 200 | 8.0 | 180 |
| 23 | Wax dispersion 1 | 15.0 | 1.0 | 10 | Resin particle dispersion 1<br>Magnetic body dispersion 1 | 150.0<br>105.0 | — | — | 9.0 | 50 | — | — | — | — | — | — | 200 | 8.0 | 180 |
| 24 | — | | — | — | Resin particle dispersion 2<br>Wax dispersion 1<br>Magnetic body dispersion 1 | 150.0<br>15.0<br>105.0 | — | — | 10.0 | 60 | — | — | — | — | — | — | 200 | 8.0 | 180 |
| 26 | — | | — | — | Resin particle dispersion 1<br>Wax dispersion 1<br>Magnetic body dispersion 1 | 150.0<br>15.0<br>35.0 | — | — | 10.0 | 60 | — | — | — | — | — | — | 200 | 8.0 | 180 |
| 29 | Magnetic body dispersion 1 | 105.0 | 1.0 | 10 | Resin particle dispersion 1<br>Wax dispersion 1 | 150.0<br>15.0 | — | — | 9.0 | 50 | — | — | — | — | — | — | 200 | 8.0 | 180 |
| 30 | — | | — | — | Resin particle dispersion 1<br>Magnetic body dispersion 3 | 150.0<br>105.0 | Noigen | 0.2 | 10.0 | 10 | Wax dispersion 1 | 15.0 | 50 | — | — | — | 150 | 10.0 | 180 |
| 31 | — | | — | — | Resin particle dispersion 1<br>Wax dispersion 1<br>Magnetic body dispersion 1 | 150.0<br>15.0<br>150.0 | — | — | 10.0 | 60 | — | — | — | — | — | — | 200 | 8.0 | 180 |

Magnetic Toner Particle 25 Production Example

| | |
|---|---|
| polyester 1 | 100.0 parts |
| paraffin wax (HNP-9, Nippon Seiro Co., Ltd.) | 4.0 parts |
| magnetic body 1 | 65.0 parts |
| charge control agent (Azo iron compound: T-77 ( Hodogaya Chemical Co., Ltd.)) | 1.0 parts |

These starting materials were preliminarily mixed for 2 minutes at 2,500 rpm using an FM mixer (FM10C, Nippon Coke & Engineering Co., Ltd.). Kneading was then performed using a twin-screw kneader/extruder (PCM-30, Ikegai Ironworks Corp.) set to a rotation rate of 200 rpm with adjustment of the set temperature so the temperature of the kneaded material in the vicinity of the kneaded material outlet was 150° C.

The obtained melt-kneaded material was cooled and the cooled melt-kneaded material was coarsely pulverized using a cutter mill. The obtained coarsely pulverized material was finely pulverized using a Turbomill T-250 (Turbo Kogyo Co., Ltd.) with adjustment of the feed rate to 20 kg/hour and adjustment of the air temperature so as to provide an exhaust temperature of 38° C. Classification was also performed using a Coanda effect-based multi-grade classifier to obtain a magnetic toner particle 25 having a volume-average particle diameter (Dv) of 7.48 μm.

Magnetic Toner Particle 26 Production Example

| | |
|---|---|
| resin particle dispersion 1 (solids fraction = 20.0 mass %) | 150.0 parts |
| wax dispersion 1 (solids fraction = 25.0 mass %) | 15.0 parts |
| magnetic body dispersion 1 (solids fraction = 25.0 mass %) | 35.0 parts |

These materials were introduced into a beaker, and, after adjustment to bring the total number of parts of water to 250 parts, the temperature was brought to 30.0° C. This was followed by mixing by stirring for 10 minutes at 8,000 rpm using a homogenizer (ULTRA-TURRAX T50, IKA®-Werke GmbH & Co. KG).

10.0 parts of a 2.0 mass % aqueous solution of magnesium sulfate was gradually added as a flocculant.

The starting dispersion was transferred to a polymerization kettle equipped with a stirring device and a thermometer, and aggregated particle growth was promoted by stirring and heating to 50.0° C. using a mantle heater.

At the stage at which 60 minutes had elapsed, an aggregated particle dispersion 26 was prepared by the addition of 200.0 parts of a 5.0 mass % aqueous solution of ethylenediaminetetraacetic acid (EDTA).

The pH of the aggregated particle dispersion 26 was then adjusted to 8.0 using a 0.1 mol/L aqueous sodium hydroxide solution, followed by heating the aggregated particle dispersion 26 to 80.0° C. and holding for 180 minutes to perform coalescence of the aggregated particle.

After the 180 minutes had elapsed, the result was a toner particle dispersion 26 in which toner particles were dispersed. After cooling at a ramp down rate of 1.0° C./minute, the toner particle dispersion 26 was filtered and throughflow washed with deionized water, and, when the conductivity of the filtrate reached to 50 mS or below, the toner particle cake was recovered.

The toner particle cake was then introduced into an amount of deionized water that was 20-times the mass of the toner particles; stirring was performed using a Three-One motor; and, once the toner particles had been thoroughly disaggregated, filtration, throughflow washing with water, and solid-liquid separation were again performed. The resulting toner particle cake was broken up with a sample mill followed by drying for 24 hours in a 40° C. oven. The resulting powder was again broken up with a sample mill followed by a supplemental vacuum drying for 5 hours in a 40° C. oven to obtain a magnetic toner particle 26.

Magnetic Toner Particle 27 Production Example

A magnetic toner particle 27 was obtained proceeding as in the Magnetic Toner Particle 25 Production Example, but changing the conditions in the preliminarily mixing with the FM mixer (FM10C, Nippon Coke & Engineering Co., Ltd.) to 1 minute at 1,000 rpm and changing the kneading conditions with the twin-screw kneader/extruder to 150 rpm for the rotation rate and 130° C. for the kneaded material temperature in the vicinity of the kneaded material outlet.

Magnetic Toner Particle 28 Production Example

| | |
|---|---|
| resin particle dispersion 1 (solids fraction = 20.0 mass %) | 150.0 parts |
| wax dispersion 1 (solids fraction = 25.0 mass %) | 15.0 parts |
| magnetic body dispersion 1 (solids fraction = 25.0 mass %) | 105.0 parts |

These materials were introduced into a beaker, and, after adjustment to bring the total number of parts of water to 250 parts, the temperature was brought to 30.0° C. This was followed by mixing by stirring for 10 minutes at 8,000 rpm using a homogenizer (ULTRA-TURRAX T50, IKA®-Werke GmbH & Co. KG).

The pH was adjusted to 5.0 by the gradual addition of 0.1 mol/L hydrochloric acid, and stirring was performed for an additional 20 minutes at 8,000 rpm.

The starting dispersion was transferred to a polymerization kettle equipped with a stirring device and a thermometer, and aggregated particle growth was promoted by heating to 50.0° C. using a mantle heater, adjusting the pH to 3.0 by the gradual addition of 0.1 mol/L hydrochloric acid, and stirring.

At the stage at which 60 minutes had elapsed, the pH of the aggregated particle dispersion 28 was adjusted to 6.8 using a 0.1 mol/L aqueous sodium hydroxide solution, followed by heating the aggregated particle dispersion 28 to 90.0° C. and holding for 180 minutes to perform coalescence of the aggregated particle.

After the 180 minutes had elapsed, the result was a toner particle dispersion 28 in which toner particles were dispersed. After cooling at a ramp down rate of 1.0° C./minute, the toner particle dispersion 28 was filtered and throughflow washed with deionized water, and, when the conductivity of the filtrate reached to 50 mS or below, the toner particle cake was recovered.

The toner particle cake was then introduced into an amount of deionized water that was 20-times the mass of the toner particles; stirring was performed using a Three-One motor; and, once the toner particles had been thoroughly disaggregated, filtration, throughflow washing with water, and solid-liquid separation were again performed. The resulting toner particle cake was broken up with a sample mill followed by drying for 24 hours in a 40° C. oven. The resulting powder was again broken up with a sample mill followed by a supplemental vacuum drying for 5 hours in a 40° C. oven to obtain a magnetic toner particle 28.

Magnetic Toner Particle 29 Production Example Pre-aggregation Step

| | |
|---|---|
| magnetic body dispersion 1 (solids fraction = 25.0 mass %) | 105.0 parts |

This material was introduced into a beaker and the temperature was brought to 30.0° C. This was followed by stirring for 10 minutes at 8,000 rpm using a homogenizer (ULTRA-TURRAX T50, IKA®-Werke GmbH & Co. KG) and by the gradual addition of 1.0 parts of a 2.0 mass % aqueous solution of magnesium sulfate as a flocculant with stirring for 10 minutes.

Aggregation Step

| | |
|---|---|
| resin particle dispersion 1 (solids fraction = 25.0 mass %) | 150.0 parts |
| wax dispersion 1 (solids fraction = 25.0 mass %) | 15.0 parts |

These materials were introduced into the aforementioned beaker, and, after adjustment to bring the total number of parts of water to 250 parts, mixing was carried out by stirring for 1 minute at 8,000 rpm.

In addition, 9.0 parts of a 2.0 mass % aqueous solution of magnesium sulfate was gradually added as a flocculant.

The starting dispersion was transferred to a polymerization kettle equipped with a stirring device and a thermometer, and aggregated particle growth was promoted by stirring and heating to 50.0° C. using a mantle heater.

At the stage at which 50 minutes had elapsed, an aggregated particle dispersion 29 was prepared by the addition of 200.0 parts of a 5.0 mass % aqueous solution of ethylenediaminetetraacetic acid (EDTA).

The pH of the aggregated particle dispersion 29 was then adjusted to 8.0 using a 0.1 mol/L aqueous sodium hydroxide solution, followed by heating the aggregated particle dispersion 29 to 80.0° C. and holding for 180 minutes to perform coalescence of the aggregated particle.

After the 180 minutes had elapsed, the result was a toner particle dispersion 29 in which toner particles were dispersed. After cooling at a ramp down rate of 1.0° C./minute, the toner particle dispersion 29 was filtered and throughflow washed with deionized water, and, when the conductivity of the filtrate reached to 50 mS or below, the toner particle cake was recovered.

The toner particle cake was then introduced into an amount of deionized water that was 20-times the mass of the toner particles; stirring was performed using a Three-One motor; and, once the toner particles had been thoroughly disaggregated, filtration, throughflow washing with water, and solid-liquid separation were again performed. The resulting toner particle cake was broken up with a sample mill followed by drying for 24 hours in a 40° C. oven. The resulting powder was again broken up with a sample mill followed by a supplemental vacuum drying for 5 hours in a 40° C. oven to obtain a magnetic toner particle 29.

Magnetic Toner Particles 30 and 31 Production Example

Magnetic toner particles 30 and 31 were obtained proceeding as in the Magnetic Toner Particle 26 Production Example, but changing to the conditions given in Table 3.

In the production example for magnetic toner particle 30, in the first aggregation step, the flocculant was added after the addition of 0.2 parts surfactant (Noigen TDS-200, DKS Co., Ltd.).

In the production example for magnetic toner particle 30, after the first aggregation step, in which aggregated particle growth was promoted at 50.0° C., the dispersion indicated in Table 3 was added and a second aggregation step, in which aggregated particle growth was again promoted at 50.0° C., was performed.

Magnetic Toners 2 to 31 Production Example

Magnetic toners 2 to 31 were obtained proceeding as in the Magnetic Toner 1 Production Example, but changing magnetic toner particle 1 to magnetic toner particles 2 to 31.

The following results are given in Table 4 for the obtained magnetic toners 2 to 31:

the volume-average particle diameter (Dv), the number-average particle diameter (Dn), the average brightness in the particle diameter range from at least Dn −0.500 to not more than Dn +0.500 (designated simply as the average brightness in the table), CV1, CV2/CV1, the average value of the occupied area percentage for the magnetic body (designated as A in the table), the average circularity, and the number-average diameter of the wax domains (designated as B in the table).

TABLE 4

| Magnetic toner No. | Dv (μm) | Dn (μm) | Average brightness | CV2/CV1 | CV1 (%) | Average circularity | B (nm) | Ws | Wc/Ws | A (%) | CV3 (%) |
|---|---|---|---|---|---|---|---|---|---|---|---|
| 1 | 7.59 | 6.65 | 41.2 | 0.82 | 2.58 | 0.981 | 300 | 7.4 | 4.7 | 17.5 | 63.2 |
| 2 | 7.47 | 6.51 | 43.1 | 0.98 | 2.87 | 0.976 | 370 | 8.1 | 4.2 | 21.3 | 76.1 |
| 3 | 7.52 | 6.54 | 42.0 | 0.98 | 3.24 | 0.971 | 310 | 7.9 | 4.4 | 18.7 | 42.1 |
| 4 | 7.58 | 6.43 | 41.0 | 0.71 | 2.98 | 0.975 | 310 | 8.4 | 3.8 | 18.0 | 74.8 |
| 5 | 7.65 | 6.43 | 41.5 | 0.72 | 2.87 | 0.982 | 300 | 9.1 | 3.3 | 15.7 | 46.0 |
| 6 | 7.88 | 6.74 | 41.5 | 0.98 | 2.91 | 0.959 | 90 | 18.5 | 0.8 | 22.2 | 77.2 |
| 7 | 7.43 | 6.43 | 41.5 | 0.99 | 3.29 | 0.959 | 90 | 18.9 | 0.9 | 18.4 | 43.2 |
| 8 | 7.54 | 6.57 | 54.2 | 0.83 | 2.67 | 0.981 | 300 | 7.6 | 4.2 | 12.1 | 71.1 |
| 9 | 7.66 | 6.74 | 35.0 | 0.86 | 2.54 | 0.971 | 270 | 6.5 | 4.8 | 23.6 | 45.2 |
| 10 | 7.60 | 6.7 | 48.2 | 0.81 | 2.67 | 0.976 | 360 | 7.2 | 4.9 | 18.5 | 75.8 |
| 11 | 7.71 | 6.41 | 31.1 | 0.81 | 2.74 | 0.964 | 210 | 6.8 | 5.1 | 30.4 | 42.8 |
| 12 | 7.85 | 6.97 | 42.4 | 0.89 | 2.67 | 0.983 | 400 | 10.1 | 3.7 | 38.7 | 63.0 |
| 13 | 7.97 | 6.58 | 35.1 | 0.95 | 2.05 | 0.961 | 450 | 5.8 | 4.0 | 43.1 | 69.2 |
| 14 | 7.41 | 6.04 | 40.2 | 0.88 | 3.89 | 0.971 | 310 | 6.2 | 5.2 | 18.5 | 67.4 |
| 15 | 7.46 | 6.47 | 43.2 | 0.85 | 4.32 | 0.968 | 270 | 4.9 | 8.0 | 17.7 | 62.2 |
| 16 | 7.55 | 6.75 | 42.4 | 0.85 | 2.20 | 0.981 | 80 | 7.4 | 4.2 | 19.2 | 63.2 |

TABLE 4-continued

| Magnetic toner No. | Dv (μm) | Dn (μm) | Average brightness | CV2/CV1 | CV1 (%) | Average circularity | B (nm) | Ws | Wc/Ws | A (%) | CV3 (%) |
|---|---|---|---|---|---|---|---|---|---|---|---|
| 17 | 7.76 | 6.81 | 45.2 | 0.93 | 2.94 | 0.975 | 520 | 9.5 | 3.7 | 18.4 | 67.8 |
| 18 | 7.42 | 6.46 | 42.3 | 0.87 | 2.51 | 0.961 | 230 | 7.3 | 4.5 | 17.4 | 63.4 |
| 19 | 7.70 | 6.72 | 41.9 | 0.82 | 2.54 | 0.951 | 180 | 7.1 | 4.5 | 16.7 | 59.7 |
| 20 | 7.54 | 6.47 | 42.0 | 0.90 | 2.34 | 0.972 | 390 | 17.2 | 2.0 | 15.3 | 62.5 |
| 21 | 7.78 | 6.55 | 40.2 | 0.88 | 2.54 | 0.978 | 320 | 18.2 | 1.8 | 18.5 | 62.1 |
| 22 | 7.43 | 6.47 | 44.1 | 0.83 | 2.41 | 0.983 | 410 | 2.1 | 9.0 | 18.5 | 67.2 |
| 23 | 7.60 | 6.4 | 43.0 | 0.86 | 3.51 | 0.979 | 390 | 1.3 | 16.2 | 18.5 | 57.8 |
| 24 | 7.58 | 6.74 | 41.1 | 0.90 | 3.20 | 0.981 | 310 | 7.5 | 4.9 | 17.4 | 65.4 |
| 25 | 7.48 | 6.38 | 44.7 | 0.91 | 2.23 | 0.955 | 200 | 17.4 | 1.6 | 30.4 | 25.4 |
| 26 | 7.97 | 6.94 | 64.2 | 0.90 | 5.78 | 0.971 | 350 | 7.5 | 4.7 | 9.5 | 62.5 |
| 27 | 7.68 | 6.12 | 45.6 | 1.07 | 4.23 | 0.952 | 320 | 15.2 | 1.6 | 18.5 | 74.6 |
| 28 | 7.81 | 6.73 | 45.7 | 0.90 | 3.78 | 0.968 | 350 | 4.2 | 9.4 | 15.9 | 26.8 |
| 29 | 7.64 | 6.54 | 35.1 | 0.93 | 2.05 | 0.953 | 400 | 13.4 | 1.9 | 43.1 | 91.2 |
| 30 | 7.83 | 6.61 | 42.2 | 1.06 | 4.10 | 0.965 | 300 | 7.1 | 5.5 | 26.7 | 35.2 |
| 31 | 8.05 | 7.00 | 28.0 | 0.96 | 1.92 | 0.961 | 200 | 3.1 | 6.5 | 50.1 | 28.8 |

Examples 2 to 24 and Comparative Examples 1 to 7

The same evaluations as in Example 1 were performed using magnetic toners 2 to 31. The results are given in Table 5.

TABLE 5

| | Magnetic toner No. | Image density (before durability test | Image density difference | Fogging | Development streaks |
|---|---|---|---|---|---|
| Example 1 | 1 | A (1.51) | A (0.02) | A (1.8) | A |
| Example 2 | 2 | C (1.37) | C (0.16) | A (3.2) | A |
| Example 3 | 3 | A (1.53) | C (0.16) | C (11.4) | A |
| Example 4 | 4 | C (1.38) | A (0.07) | A (4.5) | A |
| Example 5 | 5 | A (1.58) | A (0.04) | C (12.9) | A |
| Example 6 | 6 | C (1.36) | C (0.18) | A (2.3) | C (at or below 600 prints) |
| Example 7 | 7 | A (1.47) | C (0.18) | C (11.2) | C (at or below 600 prints) |
| Example 8 | 8 | C (1.39) | B (0.14) | A (1.5) | A |
| Example 9 | 9 | A (1.55) | B (0.13) | C (12.4) | A |
| Example 10 | 10 | C (1.36) | A (0.08) | A (1.1) | A |
| Example 11 | 11 | A (1.59) | B (0.11) | C (10.7) | A |
| Example 12 | 12 | A (1.46) | A (0.05) | B (6.7) | A |
| Example 13 | 13 | A (1.50) | B (0.10) | C (13.1) | B (at or below 1500 prints) |
| Example 14 | 14 | A (1.48) | B (0.14) | A (3.2) | A |
| Example 15 | 15 | A (1.45) | C (0.16) | B (7.7) | A |
| Example 16 | 16 | A (1.53) | A (0.04) | A (2.5) | C (at or below 800 prints) |
| Example 17 | 17 | B (1.42) | A (0.04) | A (2.7) | A |
| Example 18 | 18 | A (1.53) | B (0.13) | A (1.5) | B (at or below 1200 prints) |
| Example 19 | 19 | A (1.54) | C (0.17) | A (1.6) | C (at or below 600 prints) |
| Example 20 | 20 | A (1.47) | A (0.03) | A (3.4) | B (at or below 1100 prints) |
| Example 21 | 21 | B (1.44) | A (0.04) | B (5.9) | C (at or below 800 prints) |
| Example 22 | 22 | A (1.46) | A (0.07) | B (9.0) | A |
| Example 23 | 23 | B (1.43) | A (0.09) | C (10.4) | A |
| Example 24 | 24 | A (1.52) | A (0.03) | A (2.0) | A |
| Comparative Example 1 | 25 | A (1.53) | A (0.08) | D (17.2) | C (at or below 600 prints) |
| Comparative Example 2 | 26 | D (1.30) | A (0.09) | A (3.0) | A |
| Comparative Example 3 | 27 | A (1.49) | D (0.23) | A (3.2) | C (at or below 600 prints) |
| Comparative Example 4 | 28 | A (1.54) | A (0.04) | D (15.7) | A |

TABLE 5-continued

| | Magnetic toner No. | Image density (before durability test | Image density difference | Fogging | Development streaks |
|---|---|---|---|---|---|
| Comparative Example 5 | 29 | D (1.31) | C (0.17) | C (14.1) | C (at or below 900 prints) |
| Comparative Example 6 | 30 | B (1.41) | D (0.21) | D (15.1) | D (at or below 400 prints) |
| Comparative Example 7 | 31 | A (1.63) | D (0.21) | C (14.8) | C (at or below 900 prints) |

The present invention can thus provide a magnetic toner that—in systems where strong shear is applied to the toner—exhibits an excellent image quality, is resistant to environment variations, and exhibits an excellent stability. The present invention can also provide an image-forming method that uses this magnetic toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131082, filed Jul. 4, 2017, and Japanese Patent Application No. 2018-109318, filed Jun. 7, 2018, which are hereby incorporated by reference herein in their entirety.

What is claimed is:

1. A magnetic toner, comprising:

a magnetic toner particle containing a binder resin, a wax and a magnetic body, wherein the wax forms domains in the interior of the magnetic toner particle, the number-average diameter of the domains being 50 to 500 nm, CV2/CV1≤1.00 when Dn (m) is a number-average particle diameter of the magnetic toner, CV1 (%) is coefficient of variation of a brightness variance value of the magnetic toner in a particle diameter range of Dn ±0.500, and CV2 (%) is coefficient of variation of the brightness variance value of the magnetic toner in a particle diameter range of Dn −1.500 to Dn −0.500, an average brightness of the magnetic toner is 30.0 to 60.0 in the particle diameter range of Dn ±0.500; and coefficient of variation CV3 of an occupied area percentage for the magnetic body is 40.0 to 80.0% in a cross section of the magnetic toner observed using a transmission electron microscope when the cross section is divided with a square grid having a side of 0.8 μm.

2. The magnetic toner according to claim 1, wherein the average value of the occupied area percentage for the magnetic body is 10.0 to 40.0% in the cross section of the magnetic toner observed using a transmission electron microscope when the cross section of the magnetic toner is divided with said square grid having a side of 0.8 μm.

3. The magnetic toner according to claim 1, wherein the CV1 is 1.00 to 4.00%.

4. The magnetic toner according to claim 1, wherein an average circularity of the magnetic toner is at least 0.960.

5. The magnetic toner according to claim 1, wherein Wc/Ws is 2.0 to 10.0 in the cross section of the magnetic toner particle observed using a transmission electron microscope, where Ws is an occupied area percentage for the wax in the region within 1.0 μm from a contour of the cross section and is 1.5 to 18.0%, and We is an occupied area percentage for the wax in the interior region positioned further toward inside than inside 1.0 μm away from the contour of the cross section.

6. The magnetic toner according to claim 1, wherein the number-average particle diameter (Dn) of the magnetic toner is 3.0 to 7.0 μm.

7. The magnetic toner according to claim 1, wherein a content of the magnetic body in the magnetic toner is 35 to 50 mass %.

8. An image-forming method, comprising the steps of:

a charging step of charging an electrostatic latent image bearing member by applying voltage from the exterior to a charging member;

a latent image-forming step of forming an electrostatic latent image on the charged electrostatic latent image bearing member;

a developing step of developing the electrostatic latent image with a magnetic toner according to claim 1 carried on a toner bearing member to form a toner image on the electrostatic latent image bearing member;

a transfer step of transferring, by using an intermediate transfer member or without using an intermediate transfer member, the toner image on the electrostatic latent image bearing member to a transfer material; and a fixing step of fixing, by using a means for applying heat and pressure, the toner image that has been transferred to the transfer material, wherein the developing step is based on a mono-component contact developing system in which development is carried out by direct contact of the electrostatic latent image bearing member with the toner carried on the toner bearing member.

* * * * *